US005756276A

United States Patent [19]

Shirai

[11] Patent Number: 5,756,276

[45] Date of Patent: May 26, 1998

[54] SILVER HALIDE EMULSION AND SILVER HALIDE PHOTOGRAPHIC MATERIAL USING THE SAME

[75] Inventor: Hideyuki Shirai, Kanagawa, Japan

[73] Assignee: Fuji Photo Film Co., Ltd., Kanagawa, Japan

[21] Appl. No.: 382,209

[22] Filed: Feb. 1, 1995

[30] Foreign Application Priority Data

Feb. 4, 1994 [JP] Japan ..... 6-012962

[51] Int. Cl.[6] ..... G03C 1/035; G03C 1/18; G03C 1/09

[52] U.S. Cl. ..... 430/567; 430/588; 430/603; 430/605

[58] Field of Search ..... 430/567, 588, 430/603, 605

[56] References Cited

U.S. PATENT DOCUMENTS

| | | | |
|---|---|---|---|
| 4,063,951 | 12/1977 | Bogg | 430/569 |
| 4,386,156 | 5/1983 | Mignot | 430/567 |
| 5,320,938 | 6/1994 | House et al. | 430/567 |
| 5,422,237 | 6/1995 | Kato et al. | 430/588 |
| 5,439,789 | 8/1995 | Kato et al. | 430/588 |
| 5,476,758 | 12/1995 | Suga et al. | 430/588 |

FOREIGN PATENT DOCUMENTS 0534395 3/1993 European Pat. Off. .

OTHER PUBLICATIONS

Cristaux Dr Bromure D'Argent Plats, Limités Par Des Faces (100) Et Non Mclés, *Journal of Crystal Growth* 23 (1974) 207–213, A. Mignot, E. François and M. Catinat.

*Primary Examiner*—Mark F. Huff

*Attorney, Agent, or Firm*—Sughrue, Mion, Zinn, Macpeak & Seas, PLLC

[57] ABSTRACT

A high sensitivity silver halide emulsion excellent in keeping quality and rapid processing in which tabular silver halide grains having {100} faces as two main planes parallel to each other, an aspect ratio of 2 or more and a mean silver chloride content of 50 mol % or more occupy 50% or more of the total projected area of the silver halide grains, said silver halide emulsion being spectrally sensitized with a trimethineoxathiacyanine dye, etc., and a photographic material using the emulsion.

4 Claims, No Drawings

SILVER HALIDE EMULSION AND SILVER HALIDE PHOTOGRAPHIC MATERIAL USING THE SAME

FIELD OF THE INVENTION

The present invention relates to a silver halide photographic material, and more particularly to a silver halide emulsion excellent in photographic sensitivity and a photographic material using the same.

BACKGROUND OF THE INVENTION

Recently, there has been a growing demand for rapid processing of silver halide photographic materials. Silver bromide or silver iodobromide is generally used particularly as photographic materials for photographing. However, the use of silver chloride is advantageous for conducting rapid processing. Further, the use of tabular grains is advantageous from the viewpoint of photographic sensitivity and sharpness. However, they have {111} faces as main planes, so that they have the problem of increased intrinsic desensitization caused by a dye. It is therefore instructive to consider the use of tabular grains having {100} faces as main planes.

Silver chloride grains as silver halide grains are weak in adsorption of a dye, which raises the problems of reduced spectral sensitization and deteriorated keeping quality.

From the above, the development of silver halide grains excellent in rapid processing and improved in spectral sensitization and keeping quality and sensitizing dyes usable in combination therewith has been desired.

According to the report of A. Mignot, E. Francois and M. Catinat, "CRISTAUX DE BROMURE D'ARGENT PLATS, LIMITES PAR DES FACES (100) ET NON MACLES", *Journal of Crystal Growth*, 23, 207–213 (1974), tabular silver bromide crystals formed by {100} faces having square or rectangular main planes have been observed.

According to the disclosure of U.S. Pat. No. 4,063,951, tabular grains formed by {100} crystal faces are formed of monodisperse seed grains, and ripening in the presence of ammonia forms tabular grains having a mean aspect ratio of 1.5 to 7. Further, U.S. Pat. No. 4,386,156 discloses a method for producing a tabular silver bromide emulsion formed so as to have a mean aspect ratio of 8 or more by ripening seed grains in the absence of a non-halide complexing agent for silver ions. Furthermore, EP-A-534395 discloses a method for producing tabular grains having a high silver chloride content.

As described above, the emulsions occupied by the tabular silver halide grains having the {100} faces as the main planes are reported. However, when these are used as silver halide photographic materials, a further improvement is required particularly from the viewpoint of spectral sensitization.

SUMMARY OF THE INVENTION

It is therefore an object of the present invention to provide a high-sensitivity silver halide emulsion excellent in keeping quality and rapid processing, which is a high silver chloride emulsion containing tabular grains having {100} faces as main planes. Another object of the invention is to provide a photographic material using the above-mentioned emulsion.

According to a first aspect of the present invention, there is provided a silver halide emulsion in which tabular silver halide grains having {100} faces as two main planes parallel to each other, an aspect ratio of 2 or more and a mean silver chloride content of 50 mol % or more occupy 50% or more of the total projected area of the silver halide grains, said silver halide emulsion being spectrally sensitized with a dye represented by the following formula (I):

(I)

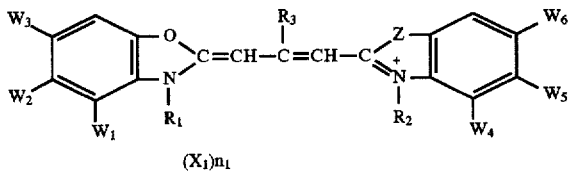

wherein Z represents a sulfur atom or a selenium atom; $W_1$, $W_3$ and $W_4$ each represents a hydrogen atom; $W_2$ not only represents a bromine atom or a phenyl group which may be substituted, but also may combine with $W_1$ or $W_3$ to form a benzene ring; $W_5$ not only represents an alkyl group having 6 or less carbon atoms, an alkoxyl group having 5 or less carbon atoms, a chlorine atom, a bromine atom, an acylamino group having 6 or less carbon atoms, a monocyclic aryl group which may be substituted, an alkoxycarbonyl group having 6 or less carbon atoms or a carboxyl group, but also may combine with $W_4$ or $W_6$ to form a tetramethylene group, a trimethylene group, a dioxymethylene group or a benzene group; $W_6$ represents a hydrogen atom, a methyl group, an ethyl group, a methoxy group or an ethoxy group; $R_1$ and $R_2$, which may be the same or different, each represents an alkyl or alkenyl group having 10 or less carbon atoms which may be substituted, and at least one of $R_1$ and $R_2$ has a sulfo group or a salt thereof; $R_3$ represents a lower alkyl group having 4 or less carbon atoms or a phenyl-substituted alkyl group; $X_1$ represents a pair ion necessary for neutralization of electric charge; and $n_1$ represents 0 or 1, and 0 for an internal salt.

According to a second aspect of the present invention, there is provided a silver halide photographic material comprising a support having provided thereon at least one silver halide emulsion layer comprising the silver halide emulsion described above. It is preferred that the tabular silver halide grains are subjected to gold and sulfur sensitization. It is particularly preferred that the tabular silver halide grains are subjected to gold and sulfur sensitization in the presence of the dye represented by formula (I).

DETAILED DESCRIPTION OF THE INVENTION

The tabular grain emulsions high in silver chloride content of the present invention are produced through the processes of nucleation, ripening and growth. Specifically, these respective processes are as follows.

1) Nucleation Process

A tabular nucleus forming a nucleus of a tabular grain is formed in high ratio under such conditions that introduction of a lattice defect easily takes place. As a method for obtaining the tabular nucleus in good reproducibility and high forming ratio, a method utilizing halogen conversion of the formed nucleus is effective. In this method, a silver halide nucleus is first formed, and subsequently, a halogen ion forming a more slightly soluble silver halide is introduced to conduct halogen conversion.

More specifically, the composition structure of a nucleus formed in nucleating is, for example, $(AgX_1|AgX_2)$ or $(AgX_1|AgX_4|AgX_3)$. This structure can be formed, for example, by simultaneously mixing an aqueous solution of a silver salt (hereinafter referred to as an "$Ag^+$ solution") with an aqueous solution of a halide (hereinafter referred to as an "$X^-$ solution"), and discontinuously changing the halogen composition of the $X^-$ solution at the gap plane. Further, the ($AgX_1|AgX_2$) structure can also be prepared by adding an $X^-$ solution to a dispersion medium solution, then adding an $Ag^+$ solution to form $AgX_1$, thereafter adding another $X^-$ solution, and subsequently adding another $Ag^+$ solution, or by a combined method thereof. $AgX_1$ is different from $AgX_2$, $AgX_1$ from $AgX_4$, and $AgX_4$ from $AgX_3$ in $Cl^-$ content or $Br^-$ content by 25 to 100 mol %, preferably 50 to 100 mol % and more preferably 75 to 100 mol %, and/or in $I^-$ content by 5 to 100 mol %, preferably 10 to 100 mol % and more preferably 30 to 100 mol %. In addition, they include embodiments in which the difference in $Cl^-$ content or $Br^-$ content is within the range specified above and the difference in $I^-$ content is 0 to 5 mol %. The size of the nuclei is preferably 0.15 μm or less, and more preferably 0.01 to 0.1 μm.

The molar ratio of $AgX_1$:$AgX_2$ in ($AgX_1|AgX_2$) or the molar ratio of $AgX_1$:$AgX_4$:$AgX_3$ in ($AgX_1|AgX_4|AgX_3$) can be changed to select the molar ratio at which most preferable embodiments of the present invention can be obtained.

The atmosphere of the dispersion medium solution in nucleating is required to be a {100} face forming atmosphere. When nucleation is conducted at an excess $Cl^-$ concentration, almost all usual conditions (pCl 0.8–3.0, pH 2–9) correspond to the {100} face forming atmosphere. In the pH range 1–7, a higher pH or a higher pCl results in a higher defect forming frequency, wherein pCl=–log[mol/liter of $Cl^-$].

The dispersion medium concentration of the dispersion medium solution in nucleating is preferably 0.1 to 10% by weight, and more preferably 0.3 to 5% by weight. The pH is preferably 1 to 10, and more preferably 2 to 8. The temperature is preferably 10° to 80° C., and more preferably 30° to 60° C. The excess $Br^-$ concentration is preferably $10^{-2}$ mol/liter or less, and more preferably $10^{-2.5}$ mol/liter or less. For the excess $Cl^-$ concentration, the pCl is preferably 0.8 to 3.0, and more preferably 1.2 to 2.8.

On nucleation, a dispersion medium can be added to a silver salt solution and/or an $X^-$ salt solution which is added to make uniform nucleation possible. The dispersion medium concentration is preferably 0.1% by weight or more, more preferably 0.1 to 2% by weight, and further more preferably 0.2 to 1% by weight. Low molecular weight gelatin having a molecular weight of 3,000 to 60,000, preferably 8,000 to 40,000, is preferably used. Further, it is more preferred that the $Ag^+$ solution and the $X^-$ solution are directly added to the solution through a porous addition system having 3 to $10^{15}$ addition pores, preferably 30 to $10^{15}$ addition pores. For the details thereof, reference can be made to the descriptions of JP-A-3-21339 (the term "JP-A" as used herein means an "unexamined published Japanese patent application"), JP-A-4-193336 and JP-A-6-86923. Gelatin having a lower methionine content results in a higher defect forming frequency. The most preferable gelatin can be selected from gelatin having a methionine content of 1 to 60 μmol according to each case to use it.

The contamination ratio of twin grains can be reduced by lowering the excess $X^-$ salt concentration or the excess $Ag^+$ salt concentration in nucleating.

The $Ag^+$ solution and the $X^-$ solution are added to the dispersion medium solution containing at least a dispersion medium and water by the double-jet method with stirring, thereby performing nucleation.

The $Cl^-$ concentration of the dispersion medium solution in nucleating is preferably $10^{-1.5}$ mol/liter or less, and the $Ag^+$ concentration is preferably $10^{-2}$ mol/liter or less. The pH is preferably 2 or more and more preferably 5 to 10. The gelatin concentration is preferably 0.1 to 3% by weight, and more preferably 0.2 to 2% by weight.

There is no limitation on the temperature in nucleating. In general, however, it is preferably 10° C. or more, and more preferably 20° to 70° C. Non-tabular grains are allowed to disappear by physical ripening after nucleation to allow the tabular grains to grow. The addition speed of the $Ag^+$ solution is preferably 0.5 to 20 g/minute per liter of solution in a vessel, and more preferably 1 to 15 g/minute. There is no particular limitation on the pH of the solution in the vessel. In general, however, the pH used is preferably 1 to 11, and more preferably 3 to 10. The most preferable pH value can be selected according to a combination of the excess silver salt concentration, the temperature, etc. to use it.

2) Ripening Process

It is impossible to selectively prepare only tabular grain nuclei in nucleating. The tabular grains are therefore allowed to grow by Ostwald ripening in the subsequent ripening process, and the other grains are allowed to disappear. The ripening temperature used is 40° C. or more, preferably 45° to 90° C., and more preferably 50° to 80° C.

The ripening is preferably conducted in the {100} face forming atmosphere. The ripening conditions are preferably selected from the range of the above-mentioned nucleating conditions. Usually, a higher pH results in a higher ripening speed in the range of pH 1 to 6, and a higher $Cl^-$ concentration results in a higher ripening speed in the range of pCl 1 to 3.

In the present invention, it is preferred that a solvent for a silver halide is not substantially allowed to coexist in ripening. The term "substantially" as used herein means that the concentration do of the solvent for the silver halide is preferably 0.5 mol/liter or less, more preferably less than 0.1 mol/liter, and most preferably less than 0.02 mol/liter.

The pH in ripening is 1 to 12, preferably 2 to 8, and more preferably 2 to 6.

As the dispersion media used in nucleating, ripening and growing, known dispersion media for silver halide emulsions can be used, and particularly, gelatin having a methionine content of 0 to 50 μmol/g, more preferably 0 to 30 μmol/g, is preferably used. When the gelatin is used in ripening and growing, thinner tabular grains narrow in diametral size distribution are preferably formed. Further, the synthetic polymers described in JP-B-52-16365 (the term "JP-B" as used herein means an "examined Japanese patent publication"), *Nippon Shashin Gakkaishi*, 29(1), 17, 22 (1966), ibid., 30(1), 10, 19 (1967), ibid., 30(2), 17 (1967) and ibid., 33(3), 24 (1967) can be preferably used as the dispersion media. Furthermore, the crystal habit regulating agents described in EP-A-534395 can be used in combination. The concentration of the dispersion media is preferably 0.1 to 10% by weight, and the regulating agents can be used preferably in an amount of $10^{-1}$ to $10^{-6}$ mol/liter, and more preferably in an amount of $10^{-2}$ to $10^{-5}$ mol/liter. They may be added at any time from before nucleation to termination of growth. They may be added additionally to the existing dispersion media, and may also be added after removal of the existing dispersion media by centrifugation, etc.

3) Growth Process

The ratio of the tabular grains is increased by ripening, and subsequently a solute is added to further allow the tabular grains to grow. Methods for adding the solute include (1) a solution addition method (a method of adding an aqueous solutio of a silver salt and an aqueous solution of a halide), (2) a method of adding fine silver halide grains previously formed, and (3) a method using both in combination. In order to allow the tabular grains to preferentially grow in the edge direction, it is necessary to lower the supersaturation concentration within such a range that the tabular grains are not affected by Ostwald ripening, thereby allowing the grains to grow. Namely, the supersaturation concentration is required to be controlled low with high precision. The method (2) is more preferred to make this possible.

In the fine-grain emulsion addition method, an emulsion of fine silver halide grains having a size of 0.15 μm or less, preferably 0.1 μm or less and more preferably 0.06 μm or less is added, and the tabular grains are allowed to grow by Ostwald ripening. The fine-grain emulsion may be added either continuously or intermittently. The fine-grain emulsion may be continuously prepared by feeding the aqueous solution of the silver salt and the aqueous solution of the halide to a mixer provided in the vicinity of a reaction vessel, followed by immediate addition to the reaction vessel, or the emulsion previously prepared in another vessel in a batch process may also be added either continuously or intermittently. It is preferred that the fine grains are substantially free from twin grains. The term "substantially free" means that the ratio of the twin grains in number is 5% or less, preferably 1% or less, and more preferably 0.1% or less.

The halogen composition of the fine grains may be silver chloride, silver bromide, silver iodide or a mixed crystal of two or more of them.

The solution conditions in grain growing are the same as those in ripening described above. Both the ripening process and the growth process are processes in which the tabular grains are allowed to grow by Ostwald ripening and the other fine grains are allowed to disappear, and are mechanically identical to each other. For the whole details of the fine-grain emulsion addition method, reference can be made to the descriptions of JP-A-4-34544, JP-A-5-281640 and JP-A-1-183417.

In order to form the fine grain substantially free from a twin plane, the aqueous solution of the silver salt and the aqueous solution of the halide are preferably added at an excess halogen ion concentration or an excess silver ion concentration of $10^{-2}$ mol/liter or less by the double-jet method to form the grain.

The fine grain forming temperature is preferably 50° C. or less, more preferably 5° to 40° C., and further more preferably 10° to 30° C. As the dispersion medium, gelatin is preferably used in which low molecular weight gelatin having a molecular weight of 2,000 to $6\times10^4$ and preferably 5,000 to $4\times10^4$ occupies 30% by weight or more, preferably 60% by weight or more and more preferably 80% by weight or more thereof. The concentration of the dispersion media is preferably 0.2% by weight or more, and more preferably 0.5 to 5% by weight.

In the nucleation process, it is preferred that $NH_3$ is not substantially allowed to coexist. The term "substantially" as used herein has the same meaning as specified above. In growing, it is also preferred that $NH_3$ is not substantially allowed to coexist. The term "substantially" as used herein means that the $NH_3$ concentration $Z_1$ is 0.5 mol/liter or less, more preferably less than 0.1 mol/liter, and further more preferably less than 0.02 mol/liter. In the nucleation and growth processes, it is preferred that a solvent for AgX other than $NH_3$ is also not substantially allowed to coexist. The term "substantially" as used herein has the same meaning as specified for the above-mentioned concentration $Z_1$. The solvents for AgX other than $NH_3$ include antifoggants such as thioethers, thioureas, thiocyanates, organic amine compounds and tetrazinedene compounds. Preferably, they are thioethers, thioureas and thiocyanates.

A dislocation line can be introduced into the grain by the halogen composition gap method, the halogen conversion method, the epitaxial growth method or a combination thereof during the grain formation, thereby further improving stress mark characteristics, reciprocity characteristics and spectral sensitization characteristics. For this, reference can be made to the descriptions of JP-A-63-220238, JP-A-64-26839, JP-A-2-127635, JP-A-3-189642, JP-A-3-175440, JP-A-2-123346, EP-A-460656 and *Journal of Imaging Science*, 32, 160–177 (1988).

Using the grains thus obtained as host grains, epitaxial grains may be formed and used as the silver halide grains of the present invention. Further, using the grains as cores, grains having dislocation lines in the inside thereof may be formed. In addition, using the grains as substrates, they can also be laminated with silver halide layers different from the substrates in halogen composition to prepare grains having all various known grain structures. For these, reference can be made to the descriptions of the literatures described below.

Further, a shallow internal latent image emulsion may be formed to use it, using the tabular grains as cores. Furthermore, core/shell type grains can also be formed. For this, reference can be made to the descriptions of JP-A-59-133542, JP-A-63-151618, and U.S. Pat. Nos. 3,206,313, 3,317,322, 3,761,276, 4,269,927 and 3,367,778.

The most important parameter to finally obtain silver halide grains high in aspect ratio is the pAg in ripening and growing, as described above. The aspect ratio of the tabular grains in the present invention is 2 to 15, preferably 3 to 13, and more preferably 4 to 10. It is preferred that the aspect ratio is within the above-mentioned range mainly from a balance of sensitivity and resistance to damage by stress.

The term "aspect ratio" as used herein means the ratio of the thickness between main planes to the mean length of edges forming the main planes, and the term "main plane" is specified as a pair of planes parallel to each other which are largest in area, of crystal faces forming substantially rectangular parallelepiped emulsion grains. It can be examined by electron beam diffraction or X-ray diffraction whether the main plane is the {100} face or not. The term "substantially rectangular parallelepiped emulsion grain" means that the main plane is formed of the {100} face, and the grain may have {111} crystal faces from 1 to 8 faces in some, cases. That is to say, 1 to 8 corners of the 8 corners of the rectangular parallelepiped may be rounded in shape. The term "mean length of edges" is specified as the length of one side of a square having an area equal to a projected area of each grain observed in a microphotograph of an emulsion grain sample.

The tabular grains in the present invention occupy 50% or more of the total projected area of the silver halide grains, preferably 60% or more, and more preferably 70% or more. For all, the upper limit is 100%.

The present invention is based on adsorption of the dye having the specified structure by surfaces of the tabular grains having the {100} faces as the main planes formed through the nucleation process, the ripening process and the growth process. The mean silver chloride content of the tabular grains existing in the emulsion is 50 to less than 100 mol %, preferably 70 to 99.99 mol %, and more preferably 80 to 99.95 mol %.

In the present invention, the sensitizing dyes represented by formula (I) are used. In formula (I), substituent groups of the phenyl group represented by $W_2$ include alkyl groups having 5 or less carbon atoms which may be branched (for example, methyl, ethyl, butyl, isobutyl and pentyl), alkoxyl groups having 4 or less carbon atoms (for example, methoxy, ethoxy, propoxy, butoxy, methoxymethoxy and methoxyethoxy), a chlorine atom, a bromine atom and acylamino groups having 4 or less carbon atoms (for example, acetylamino and propionylamino). The phenyl group may be substituted with these plural substituent groups of different kinds or the same kind.

Examples of the alkyl groups each having 6 or less carbon atoms represented by $W_5$ include a methyl group, an ethyl group, a butyl group, an isobutyl group and a pentyl group. Examples of the alkoxyl groups each having 5 or less carbon atoms represented by $W_5$ include a methoxy group, an ethoxy group, a propoxy group, a butoxy group, a pentyloxy group, a methoxymethoxy group and a methoxyethoxy group. Examples of the acylamino groups each having 6 or less carbon atoms represented by $W_5$ include an acetylamino group, a propionylamino group and a butanoylamino group. Examples of the monocyclic aryl groups which may be substituted, which are represented by $W_5$, include a phenyl group, a tosyl group, an anisyl group, a chlorophenyl group, a 3-methyl-4-chlorophenyl group, a pyridyl group and a thienyl group. Examples of the alkoxycarbonyl groups each having 6 or less carbon atoms represented by $W_5$ include an ethoxycarbonyl group and a butoxycarbonyl group.

Preferred substituent groups of the alkyl groups and the alkenyl groups represented by $R_1$ and $R_2$ include, for example, a sulfo group, a carboxyl group, halogen atoms, a hydroxyl group, alkoxyl groups each having 6 or less carbon atoms, aryl groups each having 8 or less carbon atoms which may be substituted (for example, phenyl, tolyl, sulfophenyl, carboxyphenyl), heterocyclic groups (for example, furyl, thienyl), aryloxy groups each having 8 or less carbon atoms which may be substituted (for example, chlorophenoxy, phenoxy, sulfophenoxy, hydroxyphenoxy), acyl groups each having 8 or less carbon atoms (for example, acetyl, propionyl), alkylsulfonyl or phenylsulfonyl groups each having 8 or less carbon atoms (for example, benzenesulfonyl, methanesulfonyl), alkoxycarbonyl groups each having 6 or less carbon atoms (for example, ethoxycarbonyl, butoxycarbonyl), a cyano group, alkylthio groups each having 6 or less carbon atoms (for example, methylthio, ethylthio), arylthio groups each having 8 or less carbon atoms which may be substituted (for example, phenylthio, tolylthio), carbamoyl groups each having 8 or less carbon atoms which may be substituted (for example, carbamoyl, N-ethylcarbamoyl), acylamino groups each having 8 or less carbon atoms (for example, acetylamino), alkylsulfonylamino each having 8 or less carbon atoms (for example, methanesulfonylamino), an ureido group, alkylureido groups each having 6 or less carbon atoms (for example, methylureido, ethylureido), acylamino-carbonyl groups each having 6 or less carbon atoms (for example, acetylaminocarbonyl, propionylaminocarbonyl), and alkylsulfonylaminocarbonyl groups (for example, methanesulfonylaminocarbonyl, ethanesulfonylaminocarbonyl). One or more of the substituent groups may be contained.

Examples of the groups represented by $R_1$ and $R_2$ include, for example, a methyl group, an ethyl group, a propyl group, an allyl group, a pentyl group, a hexyl group, a methoxyethyl group, an ethoxyethyl group, a phenetyl group, a tolylethyl group, a sulfo-phenetyl group, a 2,2,2-trifluoroethyl group, a 2,2,3,3-tetrafluoropropyl group, a carbamoylethyl group, a hydroxyethyl group, a 2-(2-hydroxyethoxy)ethyl group, a carboxymethyl group, a carboxyethyl group, an ethoxycarbonylmethyl group, a sulfoethyl group, a 2-chloro-3-sulfopropyl group, a 3-sulfopropyl group, a 2-hydroxy-3-sulfopropyl group a 3-sulfobutyl group, a 4-sulfobutyl group, a 2-(2,3-dihydroxy-propoxy) ethyl group, a 2-[2-(3-sulfopropoxy)ethoxy]ethyl group, a methanesulfonylaminocarbonylmethyl group, a methanesulfonylaminocarbonylethyl group, an ethanesulfonylaminocarbonylethyl group and an acetylaminocarbonylethyl group.

Examples of the lower alkyl groups represented by $R_3$ include a methyl group, an ethyl group, a propyl group and a butyl group, and examples of the phenyl-substituted alkyl groups include a benzyl group and a phenetyl group.

In the sensitizing dyes represented by formula (I) described above, the following sensitizing dyes are more preferably used.

That is to say, $W_2$ represents a substituted phenyl group or combines with $W_1$ or $W_3$ to form a benzene ring, and $R_3$ represents an ethyl group or a propyl group.

In the sensitizing dyes represented by formula (I) described above, more preferably, $W_2$ represents a phenyl group substituted by a chlorine atom, a bromine atom, a methoxy group, an ethoxy group, a methyl group or an ethyl group; $R_3$ represents an ethyl group; $W_6$ represents a hydrogen atom, a methyl group or a methoxy group; $W_5$ not only represents a methyl group, an ethyl group, a butyl group, a pentyl group, a methoxy group, an ethoxy group, a propoxy group, a butoxy group, a chlorine atom, a bromine atom, a phenyl group, a tosyl group, an anisyl group, a chlorophenyl group, a 3-methyl-4-chlorophenyl group, an ethoxycarbonyl group, a propoxycarbonyl group, a butoxycarbonyl group or a carboxyl group, but also combines with $W_4$ or $W_6$ to form a benzene group.

Preferred examples of the sensitizing dyes represented by formula (I) described above are shown below:

| Substituent Group | Preferred Example |
|---|---|
| $W_1=W_2=W_4$ | H (or $W_2$ or $W_5$ described below) |
| $W_2$ | Br, a phenyl group or a substituted phenyl group<br>Combining with $W_1$ or $W_3$ to form a condensed ring |
| $R_1=R_2$ | A lower alkyl group substituted by a sulfo group |
| Z | S or Se |
| $W_5$ | Cl, a phenyl group or a substituted phenyl group<br>Combined with W4 to form a condensed ring |
| $W_6$ | H, $CH_3$ or $OCH_3$ |
| $R_3$ | $C_2H_5$ |
| $X_1$ | $K^+$ |
| $n_1$ | 1 |

When the spectral sensitizing dyes represented by formula (I) employed in the present invention are allowed to be contained in the silver halide emulsions of the present invention, they may be directly dispersed in the emulsions, or may be dissolved in a single solvent or mixed solvents of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, acetonitrile, tetrahydrofuran, N,N-dimethylformamide, etc., followed by addition to the emulsions.

Further, there can also be used the method of dissolving a dye in an organic volatile solvent, dispersing the resulting solution in water or a hydrophilic colloid, and then adding the resulting dispersion to an emulsion, as described in U.S. Pat. No. 3,469,987; the method of dispersing a water-insoluble dye in a water-soluble solvent without dissolution, and then adding the resulting dispersion to an emulsion, as described in JP-B-46-24185; the method of forming a solution or colloidal dispersion of a dye in the coexistence of an surface active agent, and then adding it to an emulsion, as described in U.S. Pat. Nos. 3,822,135 and 4,006,025; the method of directly dispersing a dye in a hydrophilic colloid, and then adding the resulting dispersion to an emulsion, as described in JP-A-53-102733 and JP-A-58-105141; and the method of dissolving a dye using a red shift-inducing compound, and then adding the resulting solution to an emulsion, as described in JP-A-51-74624.

Furthermore, ultrasonics can also be used for dissolution.

In a more preferred method for allowing the silver halide emulsion of the present invention to contain the spectral sensitizing dye represented by formula (I), an aqueous solution of the dye in water or a hydrophilic colloid, or a dispersion in which the dye is directly finely dispersed to 1 μm or less is added to the emulsion. A method is also preferably used in which the dye is dissolved or finely dispersed in a water-soluble organic solvent or an aqueous solution of a water-soluble organic solvent, and the resulting solution or dispersion is added to the emulsion. It is more preferred that the amount of the organic solvent to be added is 5% by volume or less based on the amount of the silver halide.

Moreover, when the spectral sensitizing dye represented by formula (I) has a solubility to water at 25° C. of $5\times10^{-4}$ mol/liter or more, a method is also more preferred in which the sensitizing dye is finely pulverized and directly added as solid to the silver halide emulsion.

The sensitizing dyes used in the present invention may be added to the emulsions at any stage of emulsion preparation which has hitherto been known to be useful. For example, they may be added at the stage of silver halide grain formation and/or prior to desalting, during the desalting stage and/or at any time from completion of desalting to initiation of chemical ripening, as disclosed in U.S. Pat. Nos. 2,735,766, 3,628,960, 4,183,756 and 4,225,666, JP-A-58-184142 and JP-A-60-196749; just before or during chemical ripening as disclosed in JP-A-58-113920, and at any time and stage before emulsion coating during the period between chemical ripening and coating. Further, as disclosed in U.S. Pat. No. 4,225,666 and JP-A-58-7629, a single compound may be added alone, or combined compounds having different kinds of structures may be separately added, for example, during the same stage, or during the stage of grain formation and after completion thereof. The compounds separately added and combinations thereof may be varied.

Specified amounts of them may be added for a short period of time, or may be continuously added at any stages for a long period of time, for example, from completion of nucleation to completion of grain formation during the grain forming stage, or over almost all the chemical ripening stage. In such cases, they may be added at a constant flow rate, an accelerated flow rate or a decelerated flow rate.

There is no particular limitation on the temperature at which the sensitizing dyes are added to the silver halide emulsions. Usually, it is 35° to 70° C., and the addition temperature may be different from the ripening temperature. A method is more preferred in which the dyes are added at 45° C. or less, and then the temperature is elevated to conduct ripening.

The sensitizing dyes represented by formula (I) employed in the present invention can be added in an amount of $4\times10^{-6}$ to $8\times10^{-3}$ mol per mol of silver halide, although the amount added varies according to the shape and size of silver halide grains. For example, when the size of the silver halide grains ranges from 0.2 to 2.0 μm, the amount added is preferably from $1.7\times10^{-7}$ to $3.9\times10^{-6}$ mol per $m^2$ of surface area of the silver halide grains, and more preferably $8.0\times10^{-7}$ to $2.4\times10^{-6}$ mol/$m^2$.

These sensitizing agents may be used alone or in combination. The combinations of the sensitizing agents are frequently used, particularly for supersensitization.

The emulsions may contain substances exhibiting supersensitization which are dyes having no spectral sensitizing action themselves or substances not substantially absorbing visible light, together with the sensitizing dyes.

Examples of the dyes used in the present invention are enumerated below, but the present invention is not limited thereto.

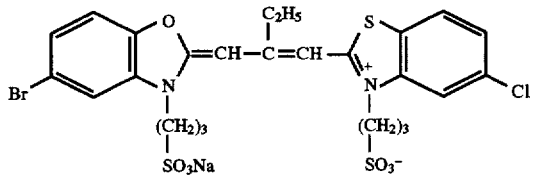

I-1

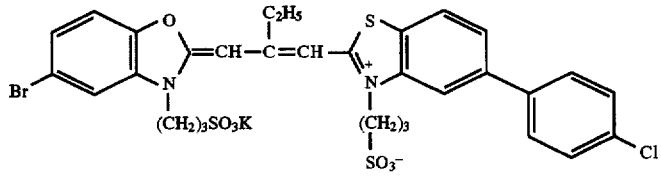

I-2

-continued
I-3
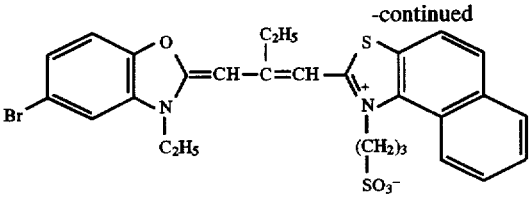
I-4
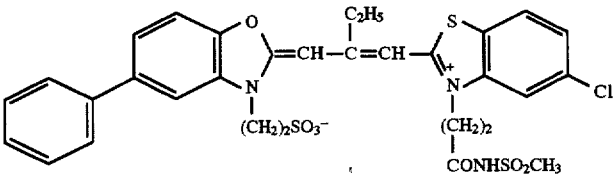
I-5
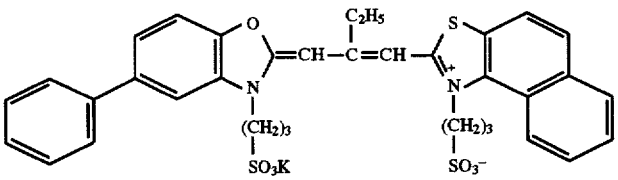
I-6
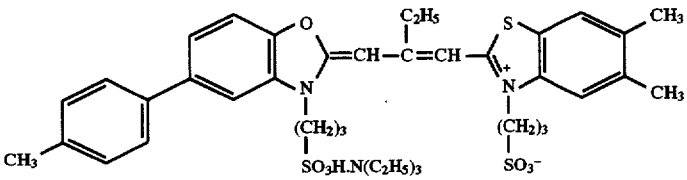
I-7
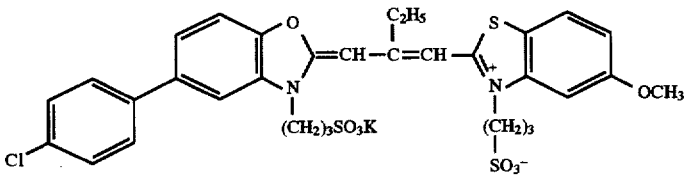
I-8
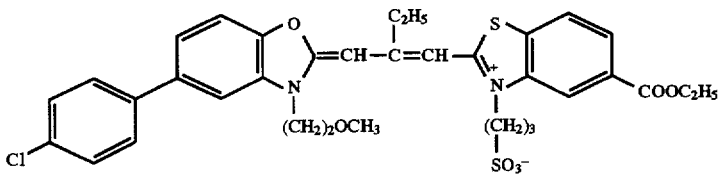
I-9
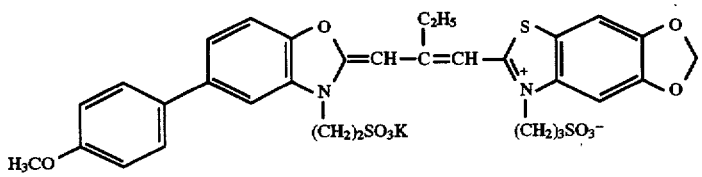
I-10
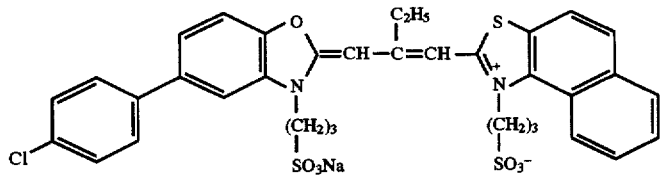
I-11
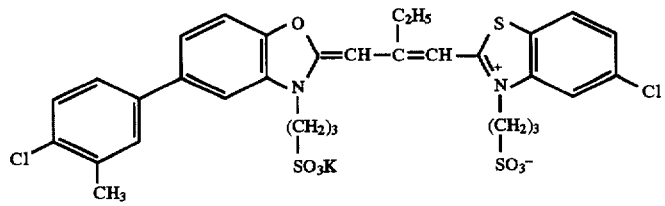

-continued
I-12
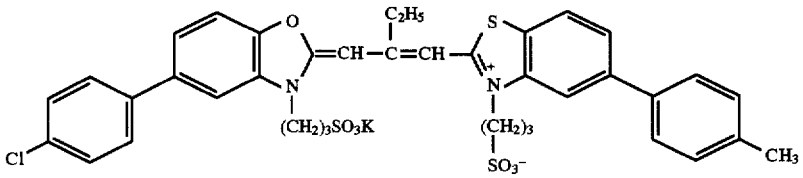
I-13
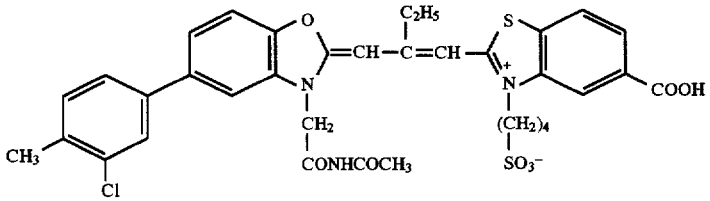
I-14
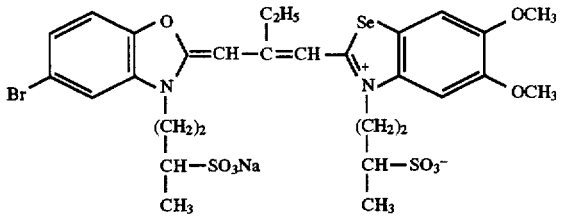
I-15
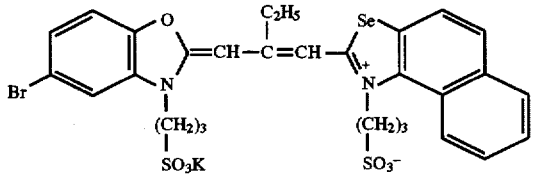
I-16
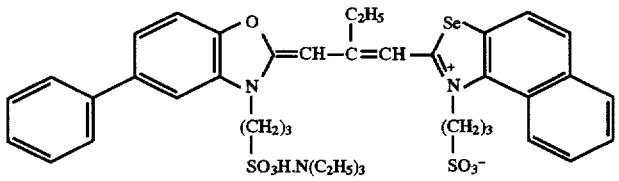
I-17
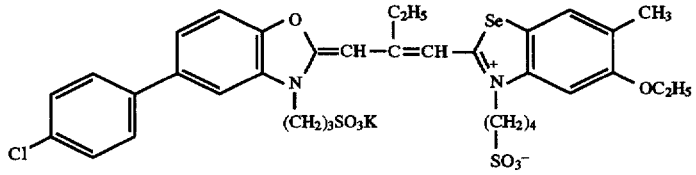
I-18
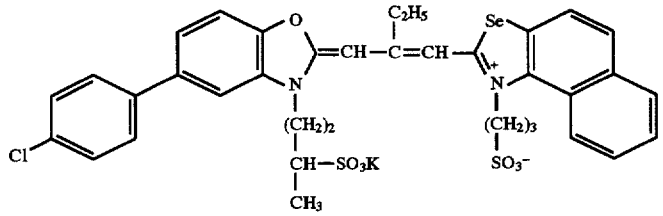
I-19
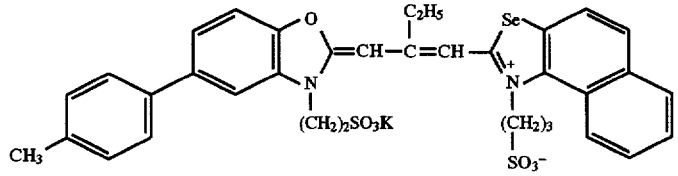

-continued
I-20
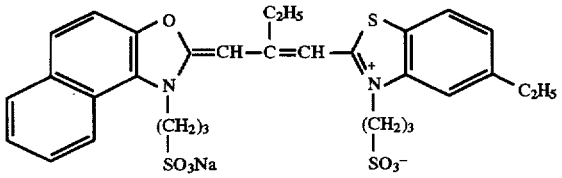
I-21
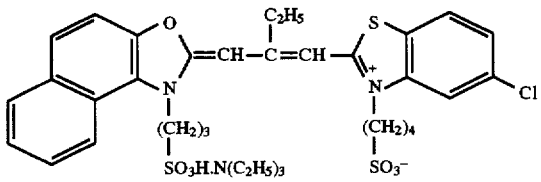
I-22
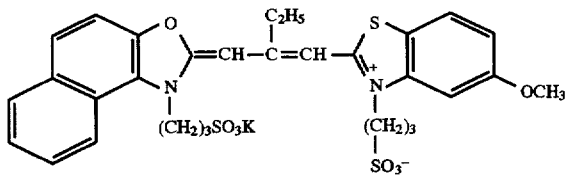
I-23
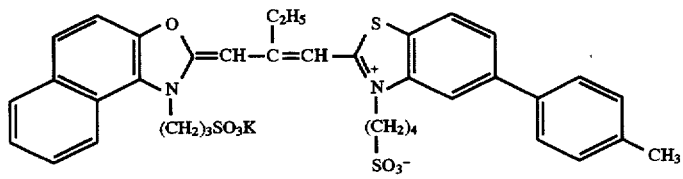
I-24
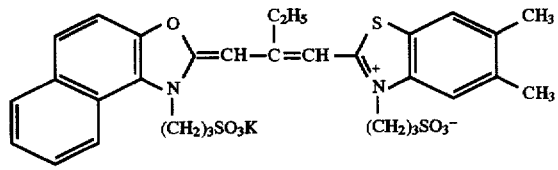
I-25
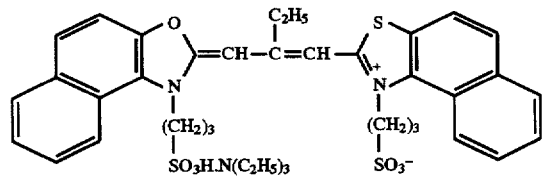
I-26
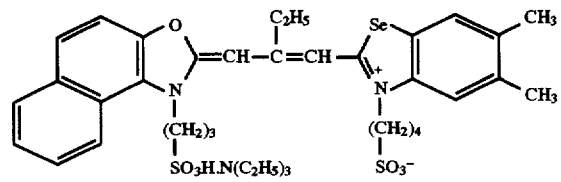
I-27
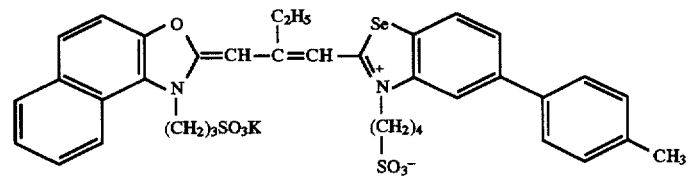
I-28
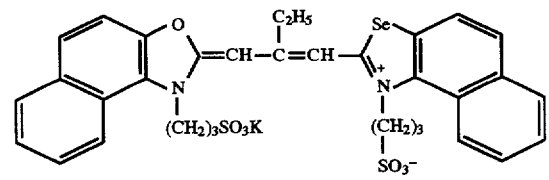

-continued

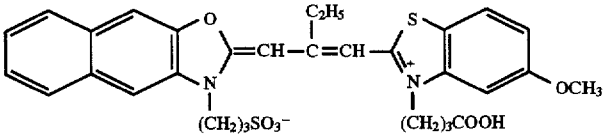

I-29

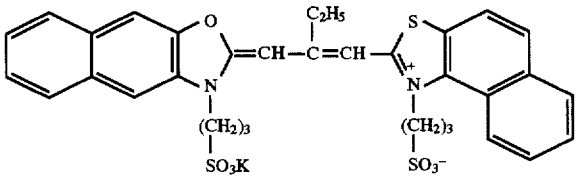

I-30

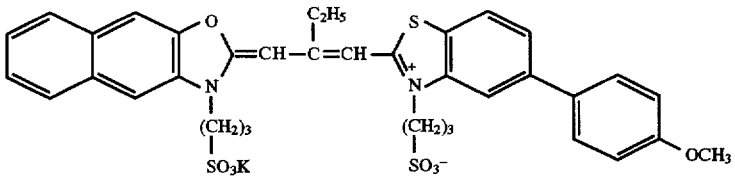

I-31

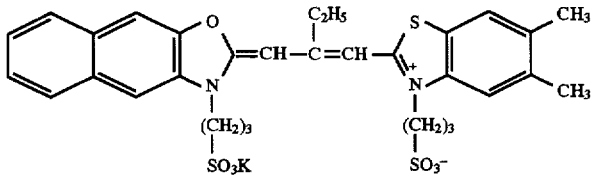

I-32

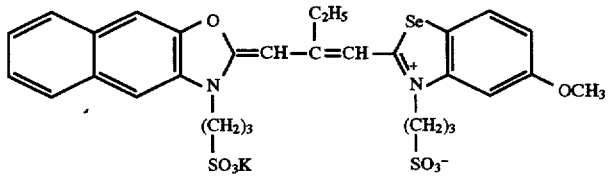

I-33

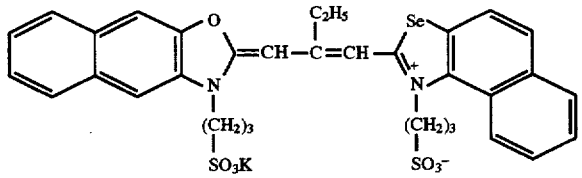

I-34

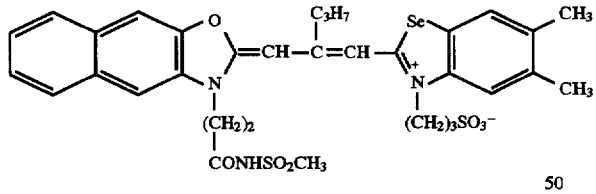

I-35

Although the above-mentioned various additives are used in the emulsions of the present invention, various other additives can be used according to their purpose.

These additives are described in *Research Disclosure*, Item 17643 (December, 1978), ibid., Item 18716 (November, 1979) and ibid., Item 308119 (December, 1989) in more detail, and corresponding portions thereof are summarized in Table 1 shown later.

The photographic material of the present invention only requires that a support is provided with at least one layer of silver halide emulsion layers such as blue-sensitive, green-sensitive and red-sensitive layers. There is no particular limitation on the number and the order of arrangement of the silver halide emulsion layers and light-insensitive layers. A typical example thereof has at least one light-sensitive layer on a support, the light-sensitive layer comprising a plurality of silver halide emulsion layers which are substantially identical in spectral sensitivity and different in sensitivity. The light-sensitive layer is a unit light-sensitive layer having spectral sensitivity to any one of blue, green and red lights. In general, in the unit light-sensitive layer of the multilayer silver halide color photographic material, the red-sensitive layer, the green-sensitive layer and the blue-sensitive layer are arranged from the support side in this order. However, the above-described order of arrangement may be reversed, or such an arrangement that a layer having a different spectral sensitivity is sandwiched between layers having the same spectral sensitivity may also be adopted, depending on its purpose.

A light-insensitive layer such as an intermediate layer, etc. may be provided between the above-descried silver halide light-sensitive layers, or in the uppermost layer or the lowermost layer.

The intermediate layers may contain couplers or DIR compounds described in JP-A-61-43748, JP-A-59-113438, JP-A-59-113440, JP-A-61-20037 and JP-A-61-20038, and may contain color stain preventing agents, as usually employed.

As the plural silver halide emulsion layers constituting each unit light-sensitive layer, a two-layer structure of a high-sensitivity emulsion layer and a low-sensitivity emulsion layer can be preferably used as described in West German Patent 1,121,470 and British Patent 923,045. It is usually preferred that the emulsion layers are arranged so as to decrease in sensitivity toward a support in turn. The light-insensitive layer may also be provided between the respective silver halide emulsion layers. Further, low-sensitivity emulsion layers may be arranged apart from a support and high-sensitivity layers near to the support, as described in JP-A-57-112751, JP-A-62-200350, JP-A-62-206541 and JP-A-62-206543.

Examples thereof include an arrangement in the order of low-sensitivity blue-sensitive layer (hereinafter referred to as BL)/high-sensitivity blue-sensitive layer (hereinafter referred to as BH)/high-sensitivity green-sensitive layer (hereinafter referred to as GH)/low-sensitivity green-sensitive layer (hereinafter referred to as GL)/high-sensitivity red-sensitive layer (hereinafter referred to as RH)/low-sensitivity red-sensitive layer (hereinafter referred to as RL) from the side farthest from a support; an arrangement in the order of BH/BL/GL/GH/RH/RL; and an arrangement in the order of BH/BL/GH/GL/RL/RH.

As described in JP-B-55-34932, layers can also be arranged in the order of blue-sensitive layer/GH/RH/GL/RL from the side farthest from a support. Further, layers can also be arranged in the order of blue-sensitive layer/GL/RL/GH/RH from the side farthest from a support, as described in JP-A-56-25738 and JP-A-62-63936.

Furthermore, three layers different in sensitivity may be arranged so that the upper layer is a silver halide emulsion layer having the highest sensitivity, the middle layer is a silver halide emulsion layer having a sensitivity lower than that of the upper layer, the lower layer is a silver halide emulsion layer having a sensitivity further lower than that of the middle layer, and the sensitivity of the three layers is successively decreased toward a support, as described in JP-B-49-15495. Even when such three layers different in sensitivity are arranged, they may be arranged in the order of middle-sensitivity emulsion layer/high-sensitivity emulsion layer/low-sensitivity layer from the side remote from the support in the same layer having the same spectral sensitivity, as described in JP-A-59-202464.

In addition, they may be arranged in the order of high-sensitivity emulsion layer/low-sensitivity emulsion layer/middle-sensitivity emulsion layer, or low-sensitivity emulsion layer/middle-sensitivity emulsion layer/high-sensitivity emulsion layer.

In the case of four layers or more, the arrangement may also be changed as described above.

As described above, various layer structures and arrangements can be selected depending on the purpose of each photographic material.

The photographic material of the present invention is a silver halide photographic material in which at least one silver halide emulsion layer formed on the support comprises 30% or more of the silver halide emulsion of the present invention, preferably 50% or more, and more preferably 70% or more.

Grains of silver halides other than the silver halides of the emulsions of the present invention contained in the photographic emulsions may have a regular crystal form such as a cubic, an octahedral or a tetradecahedral form, an irregular crystal form such as a spherical or a plate form, a form having a crystal defect such as a twin plane, or a complex form thereof.

The silver halides other than the silver halides of the emulsions of the present invention may be either finely divided grains having a grain size of about 0.2 μm or less, or large-sized grains having a diameter of a projected area up to about 10 μm. Further, they may be either polydisperse emulsions or monodisperse emulsions.

The silver halide emulsions subjected to physical ripening, chemical ripening and spectral sensitization are usually employed in the present invention.

The method of adding chalcogen compounds during preparation of emulsions as described in U.S. Pat. No. 3,772,031 is sometimes useful. Cyanates, thiocyanates, selenocyanates, carbonates, phosphates and acetates may be allowed to coexist, in addition to S, Se and Te.

The silver halide grains used in the present invention can be subjected to at least one of sulfur sensitization, selenium sensitization, gold sensitization, palladium sensitization, other noble metal sensitization and reduction sensitization at any manufacturing stages of the silver halide emulsions. It is preferred to combine two or more kinds of sensitizing methods. Various types of emulsions can be prepared according to the stages at which the grains are subjected to chemical sensitization. There are three types, the type of embedding chemical sensitizing nuclei in the inside of the grains, the type of embedding the nuclei in shallow positions from surfaces of the grains and the type of preparing the nuclei on the surfaces of the grains. For the emulsions of the present invention, the place at which the chemical sensitizing nucleus is located can be selected depending upon their purpose. However, it is generally preferred that at least one kind of chemical sensitizing nucleus is formed in the vicinity of the surface of the grain.

One chemical sensitization which can be preferably carried out in the present invention is chalcogen sensitization, noble metal sensitization or a combination thereof. It can be conducted using active gelatin as described in T. H. James, *The Theory of the Photographic Process*, 4th ed., pages 67 to 76, Macmillan (1977). Further, sulfur, selenium, tellurium, gold, platinum, palladium, iridium or a combination of these plural sensitizers can be used at a pAg of 5 to 10 at a pH 5 to 8 at a temperature of 30° to 80° C. as described in *Research Disclosure*, Vol. 120, 12008 (April, 1974), ibid., Vol. 34, 13452 (June, 1975), U.S. Pat. Nos. 2,642,361, 3,297,446, 3,772,031, 3,857,711, 3,901,714, 4,266,018 and 3,904,415, and British Patent 1,315,755. In noble metal sensitization, salts of noble metals such as gold, platinum, palladium and iridium can be used, and particularly, gold sensitization, palladium sensitization and the combination of both are preferred among others. In the case of gold sensitization, known compounds such as chloroauric acid, potassium chloroaurate, potassium aurithiocyanate, gold sulfide and gold selenide can be used. Palladium compounds mean divalent or tetravalent salts of palladium. Preferred palladium compounds are represented by $R_2PdX_6$ or $R_2PdX_4$, wherein R represents a hydrogen atom, an alkali metal atom or an ammonium group, and X represents a halogen atom such as chlorine, bromine or iodine.

Specifically, preferred examples thereof include $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$. It is preferred that the gold compounds and the palladium compounds are used in combination with thiocyanates or selenocyanates.

Hypo, thiourea compounds, rhodanine compounds and sulfur-containing compounds described in U.S. Pat. Nos. 3,857,711, 4,266,018 and 4,054,457 can be used as the sulfur sensitizers. Chemical sensitization can also be conducted in the presence of a so-called chemical sensitizing aiding agent. As the useful chemical sensitizing aiding agents, compounds are used which are known to inhibit fogging and to enhance sensitivity in the course of chemical sensitization, such as azaindene, azapyridazine and azapyrimidine. Examples of the chemical sensitizing aiding agents are described in U.S. Pat. Nos. 2,131,038, 3,411,914 and 3,554,757, JP-A-58-126526 and Duffin, *Photographic Emulsion Chemistry*, pages 138 to 143.

In the emulsions of the present invention, gold sensitization and sulfur sensitization are preferably used in combination with each other. The amounts of the gold sensitizers and the sulfur sensitizers are each preferably $1\times10^{-4}$ to $1\times10^{-7}$ mol/mol of silver halide, and more preferably $1\times10^{-5}$ to $5\times10^{-7}$ mol/mol.

As a preferred sensitizing method to the emulsions of the present invention, there is selenium sensitization. In selenium sensitization, known unstable selenium compounds are used. Specifically, selenium compounds such as colloidal metallic selenium, selenourea compounds (for example, N,N-dimethylselenourea and N,N-diethylselenourea), selenoketones and selenoamides can be used. In some cases, selenium sensitization is preferably used in combination with sulfur sensitization, noble metal sensitization or both.

It is preferred that the silver halide emulsions of the present invention are subjected to reduction sensitization during grain formation, after grain formation and before chemical sensitization or during chemical sensitization, or after chemical sensitization.

For reduction sensitization, any method can be selected from the method of adding reduction sensitizers to the silver halide emulsions, the method of growing or ripening in an atmosphere of a low pAg of 1 to 7 which is called silver ripening, and the method of growing or ripening in an atmosphere of a high pH of 8 to 11 which is called high pH ripening. Further, two or more methods can be used in combination.

The methods of adding the reduction sensitizers are preferred in that the level of reduction sensitization can be delicately controlled.

Typical examples of the known reduction sensitizers include stannous salts, ascorbic acid and derivatives thereof, amines and polyamines, hydrazine derivatives, formamidinesulfinic acid, silane compounds and borane compounds. In reduction sensitization of the present invention, these known reduction sensitizers can be selected for use, and two or more kinds of compounds can also be used in combination. Preferred compounds as the reduction sensitizers include stannous chloride, thiourea dioxide, dimethylamine borane, ascorbic acid and derivatives thereof. It is appropriate that the reduction sensitizers are added in an amount of $10^{-7}$ to $10^{-3}$ mol/mol of silver halide, although the amount added is required to be selected because of its dependency on the manufacturing conditions of the emulsions.

The reduction sensitizers are dissolved in solvents such as alcohols, glycols, ketones, esters and amides, and added during grain growth. They may be previously added to a reaction vessel. However, it is preferred thereto to add them at an appropriate time of grain growth. Further, the reduction sensitizers may be previously added to aqueous solutions of water-soluble silver salts or water-soluble alkali halides, and using these aqueous solutions, the silver halide grains may be precipitated. Furthermore, it is also preferred that solutions of the reduction sensitizers may be added in parts at several times with grain growth, or may be continuously added for a long period of time.

It is preferred to use oxidizing agents to silver in the manufacturing stage of the emulsions of the present invention. Oxidizing agents to silver mean compounds having the function of reacting with metallic silver to convert it to a silver ion. In particular, compounds are effective which convert extremely fine silver grains produced as a by-product in the course of formation of the silver halide grains and chemical sensitization to silver ions. The silver ions produced here may be form either silver salts slightly soluble in water such as silver halides, silver sulfide and silver selenide, or silver salts easily soluble in water such as silver nitrate. The oxidizing agents to silver may be inorganic compounds or organic compounds. Examples of the inorganic oxidizing agents include ozone; hydrogen peroxide and adducts thereof (for example, $NaBO_2.H_2O_2.3H_2O$, $2NaCO_3.3H_2O_2$, $Na_4P_2O_7.2H_2O_2$ and $2Na_2SO_4.H_2O_2.2H_2O$); oxygen acid salts such as peroxy acid salts (for example, $K_2S_2O_8$, $K_2S_2O_6$ and $K_2P_2O_8$), peroxy complex compounds (for example, $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (for example, $KMnO_4$) and chromates (for example, $K_2Cr_2O_7$); halogen elements such as iodine and bromine; perhalogenates (for example, potassium periodate); salts of high valent metals (for example, potassium hexacyanoferrate (II)); and thiosulfonates.

Further, examples of the organic oxidizing agents include quinones such as p-quinone; organic peroxides such as peracetic acid and perbenzoic acid; and compounds releasing active halogen (for example, N-bromosuccinimide, chloramine T and chloramine B).

In the present invention, ozone, hydrogen peroxide and the adducts thereof, the halogen elements and the thiosulfonates are preferably used as inorganic oxidizing agents, and the quinones as organic oxidizing agents. It is preferred that the above-described reduction sensitization is used in combination with the oxidizing agent to silver, which is selected for use from the method of subjecting to the reduction sensitization after use of the oxidizing agent, the method of using the oxidizing agent after the reduction sensitization and the method of using both concurrently. These methods can be selectively used either in the grain formation stage or in the chemical sensitization stage.

The silver halide photographic emulsions used in the present invention may contain various compounds to prevent fogging during manufacturing stages, storage or photographic processing of the photographic materials or to stabilize photographic properties thereof. Namely, many compounds known as antifoggants or stabilizers can be added. Examples of such compounds include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (particularly, 1-phenyl-5-mercaptotetrazole); mercaptopyrimidines; mercaptotriazines; thioketo compounds such as oxazolinethione; and azaindenes such as triazaindenes, tetraazaindenes (particularly, 4-hydroxy-substituted (1,3,3a,7)

tetraazaindenes) and pentaazaindenes. For example, the compounds described in U.S. Pat. Nos. 3,954,474 and 3,982,947, and JP-B-52-28660 can be used. One of the preferred compounds is the compound described in JP-A-63-212932. The antifoggants and the stabilizers can be added at various times, for example, before grain formation, during grain formation, after grain formation, in a washing stage, in dispersing after washing, before chemical sensitization, during chemical sensitization, after chemical sensitization and before coating, depending on their purpose. In addition to allowing the photographic materials to exhibit original antifogging effect and stabilizing effect by addition of them during preparation of the emulsions, they can be used for the multiple purposes of controlling the crystal habit of the grains, decreasing the grain size, reducing the solubility of the grains, controlling chemical sensitization and controlling the arrangement of dyes.

Although the various additives described above are used in the emulsions according to the present invention, other various additives can also be used depending on their purpose.

These additives are described in *Research Disclosure*, Item 17643 (December, 1978), ibid., Item 18716 (November, 1979) and ibid., Item 308119 (December, 1989), and corresponding portions thereof are summarized in the following table.

TABLE 1

| Type of Additives | RD17643 | RD18716 | RD308119 |
|---|---|---|---|
| 1. Chemical Sensitizers | p. 23 | p. 648, right col. | p. 996 |
| 2. Sensitivity Increasing Agents | | p. 648, right | |
| 3. Spectral Sensitizers, Supersensitizers | p. 23–24 | p. 648, right col.–p. 649, right col. | p. 996, right col.–p. 998, right col. |
| 4. Brightening Agents | p. 24 | | p. 998, right col. |
| 5. Antifoggants, Stabilizers | p. 24–25 | p. 649, right col. | p. 998, right col.–p. 1000, right col. |
| 6. Light Absorbers, Filter dyes, UV Absorbers | p. 25–26 | p. 648, right col.–p. 650, left col. | p. 1003, left col.–p. 1003, right col. |
| 7. Stain Inhibitors | p. 25, right col. | p. 650, left col.–right col. | p. 1002, right col. |
| 8. Dye Image Stabilizers | p. 25 | | p. 1002, right col. |
| 9. Hardeners | p. 26 | p. 651, left col. left col. | p. 1004, right col.–p. 1005, |
| 10. Binders | p. 26 | p. 651, left col. | p. 1003, right col.–p. 1004, right col. |
| 11. Plasticizers, Lubricants | p. 27 | p. 650, right col. | p. 1006, left col.–p. 1006, right col. |
| 12. Coating Aids, Surfactants | p. 26–27 | p. 650, right col. | p. 1005, left col.–p. 1006, left col. |
| 13. Antistatic Agents | p. 27 | p. 650 right col. | p. 1006, right col.–p. 1007, left col. |
| 14. Matting Agents | | | p. 1008, left col.–p. 1009, left col. |

In the photographic materials of the present invention, two or more kinds of light-sensitive silver halide emulsions which are different in at least one characteristic of grain size, grain size distribution, halogen composition, grain shape and sensitivity can be mixed to use them in the same layer.

The silver halide grains described in U.S. Pat. No. 4,082,553, the surfaces of which are fogged, the silver halide grains described in U.S. Pat. No. 4,626,498 and JP-A-59-214852, the interiors of which are fogged, and colloidal silver can be preferably used in light-sensitive silver halide emulsion layers and/or substantially light-insensitive hydrophilic colloidal layers. The silver halide grains the surfaces or the interiors of which are fogged mean silver halide grains which can be uniformly (non-imagewise) developed, independently of non-exposed or exposed portions of the photographic materials. Methods for preparing the silver halide grains the surfaces or the interiors of which are fogged are described in U.S. Pat. No. 4,626,498 and JP-A-59-214852.

Silver halides forming internal nuclei of core/shell type silver halide grains the interiors of which are fogged may be either the same or different in halogen composition. As the silver halide in which the interiors or the surfaces of the grains are fogged, any of silver chloride, silver chlorobromide, silver iodobromide and silver chloroiodobromide can be used. Although there is no particular limitation on the grain size of these fogged silver halide grains, the mean grain size is preferably 0.01 to 0.75 μm, and more preferably 0.05 to 0.6 μm. There in no particular limitation on the grain shape. Although an emulsion comprising regular grains and a polydisperse emulsion may be used, a monodisperse emulsion (in which at least 95% of the weight or the grain number of silver halide grains has a grain size within ±40% of a mean grain size) is preferably used.

In the present invention, it is preferred to use fine light-insensitive silver halide grains. The fine light-insensitive silver halide grains are fine silver halide grains which are not sensitive to light on imagewise exposure for obtaining dye images and are not substantially developed by their processing, and it is preferred that they are not fogged previously.

The fine silver halide grains contain 0 to 100 mol % of silver bromide, and may contain silver chloride and/or silver iodide, if necessary. It is preferred that the fine silver halide grains contain 0.5 to 10 mol % of silver iodide.

The fine silver halide grains preferably have a mean grain size (a mean value of circle-corresponding diameters of projected areas) of 0.01 to 0.5 μm, and more preferably 0.02 to 0.2 μm.

The fine silver halide grains can be prepared in a manner similar to that for preparing conventional light-sensitive silver halide grains. In this case, the surfaces of the silver halide grains is not required to be chemically sensitized, and is not also required to be spectrally sensitized. It is however preferred that known stabilizers such as triazole, azaindene, benzothiazolium, mercapto and zinc compounds are previously added to the fine silver halide grains before they are added to coating solutions. Colloidal silver can be preferably added to the fine silver halide grain-containing layers.

The photographic materials of the present invention are applied preferably in a silver amount of 6.0 g/m$^2$ or less, and most preferably in a silver amount of 4.5 g/m$^2$ or less.

Conventional photographic additives which can be used in the present invention are also described in the above three *Research Disclosure* references, and described portions relating thereto are shown in Table 1 described above.

In order to prevent the photographic characteristics from deteriorating due to a formaldehyde gas, compounds described in U.S. Pat. Nos. 4,411,987 and 4,435,503 which can react with formaldehyde to fix it are preferably added to the photographic materials.

It is preferred that mercapto compounds described in U.S. Pat. Nos. 4,740,454 and 4,788,132, JP-A-62-18539 and JP-A-1-283551 are added to the photographic materials of the present invention.

It is also preferred that the photographic materials of the present invention contain compounds described in JP-A-1-106052 which release fogging agents, development accelerators, solvents for silver halides or precursors thereof, regardless of the amount of developed silver produced by development processing.

The photographic materials of the present invention preferably contain dyes dispersed by methods described in PCT International Publication No. WO88/04794 and Published Unexamined International Application No. 1-502912 or dyes described in EP-A-317308, U.S. Pat. No. 4,420,555 and JP-A-1-259358.

Various color couplers can be used in the photographic materials of the present invention. Examples thereof are described in the patents cited in *Research Disclosure*, No. 17643, VII-C to G and ibid. No. 307105, VII-C to G described above.

Preferred examples of yellow couplers are described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649 and EP-A-249473.

As magenta couplers, 5-pyrazolone compounds and pyrazoloazole compounds are preferably used. Particularly preferred examples thereof are described in U.S. Pat. Nos. 4,310,619 and 4,351,897, European Patent 73,636, U.S. Pat. Nos. 3,061,432 and 3,725,067, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630 and PCT International Publication No. WO88/04795.

Cyan couplers include phenol couplers and naphthol couplers. Preferred examples thereof are described in U.S. Pat. Nos. 4,052,212, 4,146,396, 4,228,233, 4,296,200, 2,369,929, 2,801,171, 2,772,162, 2,895,826, 3,772,002, 3,758,308, 4,343,011 and 4,327,173, West German Patent Application (OLS) No. 3,329,729, EP-A-121365 and EP-A-249453, U.S. Pat. Nos. 3,446,622, 4,333,999, 4,775,616, 4,451,559, 4,427,767, 4,690,889, 4,254,212 and 4,296,199 and JP-A-61-42658.

Typical examples of dye-forming polymer couplers are described in U.S. Pat. Nos. 3,451,820, 4,080,211, 4,367,282, 4,409,320 and 4,576,910, British Patent 2,102,137 and EP-A-341188.

Preferred examples of couplers whose forming dyes have appropriate diffusibility include those described in U.S. Pat. No. 4,366,237, British Patent 2,125,570, European Patent 96,570 and West German Patent Application (OLS) No. 3,234,533.

Preferred colored couplers for correcting unnecessary absorption of forming dyes are described in *Research Disclosure*, No. 17643, Item VII-G, ibid. 307105, Item VII-G, U.S. Pat. No. 4,163,670, JP-B-57-39413, U.S. Pat. Nos. 4,004,929 and 4,138,258 and British Patent 1,146,368. It is also preferred to use couplers for correcting unnecessary absorption of forming dyes with fluorescent dyes released on coupling, and to use couplers having dye precursor groups as eliminable groups which can react with developing agents to form dyes. The former couplers are described in U.S. Pat. No. 4,774,181 and the latter couplers are described in U.S. Pat. No. 4,777,120.

Compounds which release photographically useful residues on coupling can also be preferably used in the present invention. Preferred DIR couplers which release development restrainers are described in the patents cited in *Research Disclosure*, No. 17643, Item VII-F and ibid., No. 307105, Item VII-F described above, JP-A-57-151944, JP-A-57-154234, JP-A-60-184248, JP-A-63-37346, JP-A-63-37350 and U.S. Pat. Nos. 4,248,962 and 4,782,012.

Preferred couplers which imagewise release nucleating agents or development accelerators on development are described in British Patents 2,097,140 and 2,131,188, JP-A-59-157638 and JP-A-59-170840. Further, preferred couplers which release fogging agents, development accelerators, solvents for silver halides and the like by oxidation-reduction reaction with oxidation products of developing agents are described in JP-A-60-107029, JP-A-60-252340, JP-A-1-44940 and JP-A-1-45687.

Other compounds which can be used in the present invention include competitive couplers described in U.S. Pat. No. 4,130,427, multiequivalent couplers described in U.S. Pat. Nos. 4,283,472, 4,338,393 and 4,310,618, DIR redox compound releasing couplers, DIR coupler releasing couplers, DIR coupler releasing redox compounds and DIR redox releasing redox compounds described in JP-A-60-185950 and JP-A-62-24252, couplers which release dyes recoloring after elimination described in EP-A-173302 and EP-A-313308, bleach accelerator releasing couplers described in *Research Disclosure*, No. 11449, ibid., No. 24211 and JP-A-61-201247, ligand releasing couplers described in U.S. Pat. No. 4,555,477, leuco dye releasing couplers described in JP-A-63-75747 and fluorescent dye releasing couplers described in U.S. Pat. No. 4,774,181.

The couplers used in the present invention can be incorporated in the photographic materials by various conventional dispersing methods inclusive of oil-in-water dispersion methods and latex dispersion methods.

Examples of high boiling solvents used in oil-in-water dispersion methods are described in U.S. Pat. No. 2,322,027, etc.

Examples of the high boiling solvents having a boiling point of 175° C. or more at atmospheric pressure which are used in the oil-in-water dispersion methods include phthalates (for example, dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate and bis(1,1-diethylpropyl) phthalate), phosphates or phosphonates (for example, triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphonate), benzoates (for example, 2-ethylhexyl benzoate, dodecyl benzoate and 2-ethylhexyl p-hydroxybenzoate), amides (for examples, N,N-diethyldodecane-amide, N,N-diethyllaurylamide and N-tetradecylpyrrolidone), alcohols or phenols (for example, isostearyl alcohol and 2,4-di-tert-amylphenol), aliphatic carboxylic acid esters (for example, bis(2-ethylhexyl) sebacate, dioctyl azelate, glycerol tributyrate, isostearyl lactate and trioctyl citrate), aniline derivatives (for example, N,N-dibutyl-2-butoxy-5-tert-octylaniline), and hydrocarbons (for example, paraffin, dodecylbenzene and diisopropylnaphthalene). Organic solvents having a boiling point of about 30° C. or more and preferably about 50° C. to about 160° C. may be used as auxiliary solvents. Typical examples thereof include ethyl acetate, butyl acetate, ethyl propionate, methyl ethyl ketone, cyclohexanone, 2-ethoxyethyl acetate and dimethylformamide.

The stages and effects of latex dispersion methods and examples of latexes for impregnation are described in U.S.

Pat. No. 4,199,363, West German Patent Application (OLS) Nos. 2,541,274 and 2,541,230.

It is preferred that the photographic materials of the present invention contain various preservatives or antifungal agents such as 1,2-benzisothiazoline-3-one, n-butyl p-hydroxybenzoate, phenol, 4-chloro-3,5-dimethylphenol, 2-phenoxyethanol and 2-(4-thiazolyl)benzimidazole described in JP-A-63-257747, JP-A-62-272248 and JP-A-1-80941 and phenetyl alcohol.

The present invention can be applied to various photographic materials. Typical examples thereof include color negative films for general use or cinematographic use, color reversal films for slides or television, color paper, color positive films and color reversal paper.

Appropriate supports which can be used in the photographic materials of the present invention are described, for example, in *Research Disclosure*, No. 17643, page 28, ibid., No. 18716, page 647, right column to page 648, left column, and ibid., No. 307105, page 879.

In the photographic materials of the present invention, the total film thickness of all hydrophilic colloidal layers on the side having an emulsion layer is preferably 28 μm or less, more preferably 23 μm or less, further preferably 18 μm or less, and particularly preferably 16 μm or less. The film swelling speed $T_{1/2}$ is preferably 30 seconds or less, and more preferably 20 seconds or less. The film thickness means a thickness measured under conditions of 25° C.—55% RH (for 2 days), and the film swelling speed $T_{1/2}$ can be measured by methods known in the art. For example, measurement can be made by using a swellometer described in A. Green et al., *Photogr. Sci. Eng.*, Vol.19, No.2, pages 124 to 129. $T_{1/2}$ is defined as a time required to reach ½ of a saturated film thickness, taking 90% of a maximum thickness of a swelled film reached by processing with a color developing solution at 30° C. for 3 minutes and 15 seconds as a saturated film thickness.

The film swelling speed $T_{1/2}$ can be adjusted by adding a hardening agent to gelatin used as a binder or changing the above-described aging conditions after coating. The swelling rate is preferably 150 to 400%. The swelling rate can be calculated according to the equation: (maximum swelled film thickness—film thickness)/film thickness, from the maximum thickness of the swelled film under the above-described conditions.

The photographic material of the present invention is preferably provided with a hydrophilic colloidal layer (referred to as a back layer) having a total dry film thickness of 2 to 20 μm on the side opposite to a side having an emulsion layer. It is preferred that the back layers contain the above-described light absorbers, filter dyes, ultraviolet absorbers, antistatic agents, hardening agents, binders, plasticizers, lubricants, coating aids and surfactants. The swelling rate of the back layers is preferably 150 to 500%.

The photographic materials of the present invention can be developed by usual methods described in *Research Disclosure*, No. 17643, pages 28 and 29, ibid., No. 18716, page 651, left column to right column, and ibid., No. 307105, pages 880 and 881.

Color developing solutions used for processing of the photographic materials of the present invention are preferably aqueous alkaline solutions mainly containing aromatic primary amine color developing agents. Although the aminophenol compounds are also useful as the color developing agents, p-phenylenediamine compounds are preferably used. Typical examples thereof include 3-methyl-4-amino-N,N-diethylaniline, 3-methyl-4-amino-N-ethyl-N-β-hydroxyethyl-aniline, 3-methyl-4-amino-N-ethyl-N-β-methanesulfonamido-ethylaniline, 3-methyl-4-amino-N-ethyl-N-β-methoxyethyl-aniline, 4-amino-3-methyl-N-methyl-N-(3-hydroxypropyl)-aniline, 4-amino-3-methyl-N-ethyl-N-(3-hydroxypropyl)aniline, 4-amino-3-methyl-N-ethyl-N-(2-hydroxypropyl)aniline, 4-amino-3-methyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxy-butyl)aniline, 4-amino-3-methyl-N,N-bis(5-hydroxypentyl)-aniline, 4-amino-3-methyl-N-(5-hydroxyphenyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and sulfates, hydrochlorides or p-toluenesulfonates thereof. Of these compounds, 3-methyl-4-amino-N-ethyl-N-β-hydroxyethylaniline, 4-amino-3-methyl-N-ethyl-N-(3-hydroxypropyl)-aniline, 4-amino-3-methyl-N-ethyl-N-(4-hydroxybutyl)aniline, and hydrochlorides, p-toluenesulfonates or sulfates thereof are particularly preferred. These compounds can also be used as a combination of two or more of them.

The aromatic primary amine developing agents are used preferably in an amount of 0.0002 to 0.2 mol per liter of color developing solution, and more preferably in an amount of 0.001 to 0.1 mol per liter.

The color developing solutions generally contain pH buffers such as carbonates, borates, phosphates or 5-sulfosalicylates of alkali metals, and developing inhibitors or antifoggants such as chlorides, bromides, iodides, benzimidazoles, benzothiazoles or mercapto compounds. Further, the color developing solutions may contain various preservatives such as hydroxylamines represented by formula (I) of JP-A-3-144446 in addition with hydroxylamine and diethylhydroxylamine, sulfites, hydrazines such as N,N-biscarboxymethylhydrazine, phenylsemicarbazides, triethanolamine and catecholsulfonic acids; organic solvents such as ethylene glycol and diethylene glycol; development accelerators such as benzyl alcohol, polyethylene glycol, quaternary ammonium salts and amines; dye forming couplers; competitive couplers; auxiliary developing agents such as 1-phenyl-3-pyrazolidone; tackifiers; and various chelating agents represented by aminopolycarboxylic acids, aminopolyphosphonic acids, alkylphosphonic acids and phosphonocarboxylic acids (for example, ethylenediaminetetraacetic acid, nitrilotriacetic acid, diethylenetriaminepentaacetic acid, cyclohexanediaminetetraacetic acid, hydroxyethylimino-diacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts thereof) as required.

Of the above, substituted hydroxylamines are most preferred as the preservatives, and hydroxylamines having alkyl groups as substituent groups, the alkyl groups being substituted by water-soluble groups such as sulfo, carboxyl and hydroxyl groups, are preferred among others. Most preferred examples thereof include N,N-bis(2-sulfoethyl)-hydroxylamine and alkali metal salts thereof.

As the chelating agents, biodegradable compounds are preferably used. Examples thereof include chelating agents described in JP-A-63-146998, JP-A-63-199295, JP-A-63-

267750, JP-A-63-267751, JP-A-2-229146, JP-A-3-186841, German Patent 3739610 and European Patent 468325.

It is preferred that a processing solution in a replenisher tank or a processing tank for the color developing solution is shielded with a liquid agent such as a high boiling organic solvent to reduce the contact area with air. As the liquid shielding agent, liquid paraffin is most preferred, and it is particularly preferred to use it in a replenisher.

In the present invention, the processing temperature in the color developing solutions is 20° to 55° C., and preferably 30° to 55° C. The processing time is 20 seconds to 5 minutes, preferably 30 seconds to 3 minutes and 20 seconds, and more preferably 40 seconds to 2 minutes and 30 seconds for photographic materials for photographing. For photographic materials for printing, it is 10 seconds to 1 minute and 20 seconds, preferably 10 seconds to 60 seconds, and more preferably 10 seconds to 40 seconds.

When reversal processing is performed, ordinary black-and-white development is usually conducted, followed by color development. For black-and-white developers used in this case, known black-and-white developing agents such as dihydroxybenzenes (for example, hydroquinone), 3-pyrazolidones (for example, 1-phenyl-3-pyrazolidone), or aminophenols (for example, N-methyl-p-aminophenol) can be used alone or in combination.

These color developing solutions and black-and-white developing solutions are generally adjusted to pH 9 to 12. Although the replenishment rate of these developing solutions vary according to color photographic materials to be processed, it is generally 3 liters or less per $m^2$ of photographic material, and it can also be reduced to 500 ml or less by lowering the concentration of bromide ions in the replenishers. When the replenishment is reduced, the contact area with air in a processing tank is preferably lowered to prevent liquid evaporation and air oxidation.

The contact area of a photographic processing solution with air in a processing tank can be represented by the opening ratio defined below:

Opening ratio ($cm^{-}$)=[Contact area of processing solution with air ($cm^2$)]÷[Volume of processing solution ($cm^3$)]

The opening ratio described above is preferably 0.1 $cm^{-1}$ or less, and more preferably 0.001 $cm^{-1}$ to 0.05 $cm^{-1}$. Methods for lowering the opening ratio like this include the method of using a movable lid as described in JP-A-1-82033 and the slit development processing method as described in JP-A-63-216050, in addition to the method of providing a shelter such as a floating lid on a surface of the photographic processing solution in the processing tank. It is desirable to reduce the opening ratio, not only for both the color development and black-and-white development steps, but also for various succeeding steps, for example, bleaching, bleach-fixing, fixing, washing and stabilization. The replenishment rate can also be reduced by using means for depressing accumulation of bromide ions in the developing solution.

After color development, the photographic emulsion layers are generally bleached. Bleaching may be conducted simultaneously with fixing (bleach-fixing), or separately. Further, bleach-fixing may be conducted after bleaching to expedite processing. Furthermore, processing in two successive bleach-fixing baths, fixing before bleach-fixing or bleaching after bleach-fixing may also be arbitrarily applied depending on the purpose. As bleaching agents, for example, compounds of polyvalent metals such as iron (III), peroxides, quinones and nitro compounds are used. Typical examples of the bleaching agents include bleaching agents including organic complex salts of iron (III) such as iron complex salts of ethylenediaminetetraacetic acid, diethylenetriaminepentaacetic acid, cyclohexanediaminetetraacetic acid, methyliminodiacetic acid, glycoletherdiaminetetraacetic acid and 1,3-propylenediaminetetraacetic acid described in JP-A-4-121739, page 4, lower right column to page 5, upper left column; carbamoyl bleaching agents described in JP-A-4-73647; bleaching agents having heterocycles described in JP-A-4-174432; bleaching agents including ferric complex salts of N-(2-carboxyphenyl)iminodiacetic acid described in EP-A-520457; bleaching agents including ferric complex salts of ethylenediamine-N-2-carboxyphenyl-N,N',N'-triacetic acid described in JP-A-5-66527; bleaching agents described in EP-A-501479; bleaching agents described in JP-A-4-127145; and ferric complex salts of aminopolycarboxylic acids or salts thereof described in JP-A-3-144446, page (11).

The iron (III) complex salts of organic aminocarboxylic acids are particularly useful to both the bleaching solutions and the bleach-fixing solutions. The pH of the bleaching solutions and the bleach-fixing solutions using the iron (III) complex salts of organic aminocarboxylic acids is usually 4.0 to 8.0. However, processing can also be conducted at a lower pH for rapid processing.

It is preferred that such bleaching is carried out immediately after color development. In the case of reversal processing, however, processing is generally conducted through compensating baths (which may be bleaching promoting baths). These compensating baths may contain image stabilizers given later.

In the present invention, desilverization baths may contain rehalgenating agents described in JP-A-3-144446, page (12) mentioned above, pH buffers and known additives such as aminopolycarboxylic acids and organic phosphonic acids, in addition to the bleaching agents.

Further, in the present invention, various bleaching promoters may be added to the bleaching solutions and the preceding baths thereof. Examples of the bleaching promoters which can be used include compounds having mercapto groups or disulfide groups described in U.S. Pat. No. 3,893,858, German Patent 1,290,821, British Patent 1,138,842, JP-A-53-95630 and *Research Disclosure*, No. 17129 (July, 1978); thiazolidine derivatives described in JP-A-50-140129; thiourea derivatives described in U.S. Pat. No. 3,706,561; iodides described in JP-A-58-16235; polyethylene oxides described in German Patent 2,748,430; and polyamine compounds described in JP-B-45-8836. Furthermore, compounds described in U.S. Pat. No. 4,552,834 are also preferably used. These bleaching agents may be added to the photographic materials. When color photographic materials for photographing are subjected to bleach-fixing, these bleaching promoters are particularly effective. In particular, the mercapto compounds described in British Patent 1,138,842 and JP-A-2-190856 are preferred.

Besides the above-mentioned compounds, organic acids are preferably added to the bleaching solutions and the bleach-fixing solutions to prevent bleaching stains. Particularly preferred organic acids have a acid dissociation constant (pKa) of 2 to 5.5, and particularly, dibasic acids are preferred. Specifically, for the organic acids, preferred examples of monobasic acids include acetic acid, propionic acid and hydroxyacetic acid, and more preferred examples of the dibasic acids include succinic acid, glutaric acid, maleic acid, fumaric acid, malonic acid and adipic acid. Of these, succinic acid, glutaric acid and maleic acid are most preferred.

It is preferred that the total time required for the desilverization stage is shorter as long as it does not result in poor desilverization. The time is preferably 1 to 3 minutes, and more preferably 1 to 2 minutes. Further, the processing temperature is 25° to 50° C., and preferably 35° to 45° C. Within the preferred temperature range, the desilverization speed is improved, and generation of stains after processing is effectively prevented.

In the present invention, it is particularly preferred that aeration is conducted on the processing solutions having bleaching ability in processing, because the photographic performance is maintained very stable. Means known in the art can be used for aeration. For example, air can be blown into the processing solutions having bleaching ability, or air can be absorbed into the solutions by use of an ejector.

In blowing air into the solutions, it is preferred to release air in the solutions through diffusers having fine pores. Such diffusers are widely used in aeration tanks, etc. in the activated sludge process. With respect to aeration, the description in Z-121, Using Process C-41, third edition, pages BL-1 and BL-2 (published by Eastman Kodak, 1982) can be utilized. In processing using the processing solutions having bleaching ability, it is preferred that stirring is strengthened, and for its practice, the contents described in JP-A-3-33847, page 8, upper right column, line 6 to lower left column, line 2 can be utilized as such.

In the desilverization stage, it is preferred that stirring is strengthened as much as possible. Specific examples of methods for strengthen stirring include the method of colliding a jet stream of a processing solution on an emulsion surface of a photographic material described in JP-A-62-183460, the method of enhancing the stirring effect by use of rotating means described in JP-A-62-183461, the method of moving a photographic material while bringing a wiper blade provided in a solution into contact with an emulsion surface to produce turbulence on the emulsion surface, thereby improving the stirring effect, and the method of increasing the overall circulating flow rate of a processing solution. Such means for improving the stirring effect are effective for all of the bleaching, bleach-fixing and fixing solutions. Improved stirring is considered to hasten the supply of the bleaching solutions and the fixing solutions into emulsion films, resulting in an increase in desilverization speed. The above-described means for improving the stirring effect are more effective when using the bleaching promoters, by which the promoting effect can significantly be enhanced and the fixing inhibiting action can be removed.

It is preferred that automatic processors used for processing the photographic materials of the present invention have means for transferring photographic materials described in JP-A-60-191257, JP-A-60-191258 and JP-A-60-191259. As described in JP-A-60-191257, such a transferring means can significantly reduce introduction of the processing solution from a preceding bath to a subsequent bath, and the processing solution is effectively prevented from deteriorations of qualities. Such an effect is particularly effective to shorten the processing time in each stage and to reduce the replenishment rate of the processing solution.

Further, for the processing solutions having bleaching ability used in the present invention, overflowed solutions after use in processing are recovered, and the composition is corrected by addition of components, whereby the solutions can be reused. Such a method is usually called regeneration. In the present invention, such generation is preferably used. As to the details of regeneration, the description in Fuji Film Processing Manual, Fuji Color Negative Film, CN-16 Processing, pages 39 and 40 (revised in August, 1990) published by Fuji Photo Film Co. Ltd. can be applied.

Kits for preparing the processing solutions having bleaching ability may be either in solid form or in liquid form. When ammonium salts are excluded, almost all raw materials are supplied in powder form, and low in moisture absorption. The kits are therefore easily produced in powder form.

Kits for the above-described regeneration are preferably in powder form, because excess water is not used from the viewpoint of a reduction in the amount of waste liquid and they can be directly added.

With respect to the regeneration of the processing solutions having bleaching ability, in addition to the above-described aeration, methods described in *Shashin Kohqaku no Kiso (the Elements of Photographic Technology)-Ginen Shashin-hen (the Volume of Silver Salt Photography)*, (edited by Nippon Shashin Gakkai (the Photographic Society of Japan), published by Colona, 1979), etc. can be employed. Examples thereof include methods for regenerating the bleaching solutions by use of bromic acid, chlorous acid, bromine, bromine precursors, persulfates, hydrogen peroxide, catalysts-utilizing hydrogen peroxide, bromous acid, ozone, etc., as well as electrolytic regeneration.

In regeneration by electrolysis, an anode and a cathode can be placed in the same bleaching solution, or an cathode tank can be separated from an anode tank by use of a diaphragm to conduct regeneration. Further, the bleaching solution and the developing solution and/or the fixing solution can be concurrently regenerated also using a diaphragm.

The regeneration of the fixing solutions and the bleach-fixing solutions is performed by electrolytic reduction of accumulated silver ions. In addition, it is preferred from the viewpoint of keeping fixing performance to remove accumulated halogen ions through an anion exchange resin.

In order to reduce the amount of washing water used, ion exchange or ultrafiltration is used. In particular, ultrafiltration is preferably used.

The photographic materials of the present invention are generally subjected to washing and/or stabilization after desilverization. The amount of washing water used in the washing stage can be widely established depending on the characteristics of the photographic materials (for example, materials to be used such as couplers), the use, the temperature of washing water, the number of washing tanks (the number of stages), the countercurrent or concurrent replenishment system and other various conditions. Of these, the relationship between the amount of washing water and the number of washing tanks in the multistage countercurrent system can be determined by the method described in *Journal of the Society of Motion Picture and Television Engineers*, 64, 248–253 (May, 1955). According to the multistage countercurrent system described in the above-described literature, the amount of washing water can be noticeably reduced. However, the increased residence time of washing water in the tanks produces the problem that bacteria propagate in water and the resulting suspended matter adheres on the photographic materials. In order to solve such a problem in the processing of the color photographic materials of the present invention, a method for reducing calcium and magnesium ions described in JP-A-62-288838 can be very effectively used. Disinfectants can also be used, which include isothiazolone compounds and thiabendazoles described in JP-A-57-8542; chlorine disinfectants such as chlorinated sodium isocyanurate; and disinfectants such as benzotriazole described in Hiroshi Horiguchi, *Bohkin Bohbaizai no Kagaku (Chemistry of Bacteria Prevention and Fungus Prevention)*, Sankyo Shuppan (1986), *Biseibutsu no Mekkin, Sakkin, Bohbai Gijutsu (Sterilization, Pasteurization and Fungus Prevention Techniques of Microorganisms)*, edited by Eisei Gijutsukai, Kogyo Gijutsukai (1982) and *Bokin Bohbaizai Jiten (Dictionary of Disinfectants and Fungicides)*, edited by Nippon Bohkin Bohbai Gakkai (1986).

The pH of washing water used in the processing of the photographic materials of the present invention is 4 to 9, and preferably 5 to 8. The temperature of washing water and the washing time can be variously set according to the characteristics and the use of the photographic materials. In general, however, the washing time is 20 seconds to 10 minutes at 15° to 45° C., and preferably 30 seconds to 5 minutes at 25° to 40° C. Further, the photographic materials of the present invention can also be processed directly with the stabilizing solutions, instead of washing described above. In such stabilization, all the known methods described in JP-A-57-8543, JP-A-58-14834 and JP-A-60-220345 can be used.

The stabilizing solutions contain compounds for stabilizing dye images such as formalin, benzaldehyde compounds such as m-hydroxybenzaldehyde, formaldehydebisulfite addition compounds, hexamethylenetetramine and derivatives thereof, hexahydrotriazine and derivatives thereof, N-methylol compounds such as dimethylolurea and N-methylolpyrazole, organic acids and pH buffers. These compounds are preferably added in an amount of 0.001 to 0.02 mol per liter of stabilizing solution. The lower concentration of free formaldehyde in the solutions is preferred because of less scattering of formaldehyde gas. From such a viewpoint, preferred examples of the dye image stabilizers include m-hydroxybenzaldehyde, hexamethylenetetramine, N-methylolazoles such as N-methylolpyrazole described in JP-A-4-270344, and azolylmethylamines such as N,N'-bis (1,2,4-triazole-1-ylmethyl)piperazine described in JP-A-4-313753. In particular, it is preferred to use azole compounds such as 1,2,4-triazole described in JP-A-4-359249 (corresponding to EP-A-519190) in combination with azolylmethylamines and derivatives thereof such as 1,4-bis (1,2,4-triazole-1-ylmethyl)piperazine, because of high image stability and low formaldehyde vapor pressure. In addition, the stabilizing solutions also preferably contain ammonium compounds such as ammonium chloride and ammonium sulfite, compounds of metals such as Bi and Al, brightening agents, hardening agents, alkanolamines described in U.S. Pat. No. 4,786,583, and preservatives which can be added to the above-mentioned fixing solutions and bleach-fixing solutions, for example, sulfinic acid compounds described in JP-A-1-231051, if necessary.

It is preferred that washing water and the stabilizing solutions can contain various surfactants to prevent water spots from being produced in drying the photographic materials after processing. The use of nonionic surfactants is preferred among others, and particularly, alkylphenol-ethylene oxide adducts are preferred. In particular, the alkylphenols are preferably octylphenol, nonylphenol, dodecylphenol and dinonylphenol, and the molar number of ethylene oxide added is preferably 8 to 14. Further, the use of silicone surfactants having a high antifoaming effect is also preferred.

It is preferred that washing water and the stabilizing solutions contain various chelating agents. Preferred examples of the chelating agents include aminopolycarboxylic acids such as ethylenediaminetetraacetic acid and diethylenetriaminepentaacetic acid; organic phosphonic acids such as 1-hydroxyethylidene-1,1-diphosphonic acid, N,N,N'-trimethylenephosphonic acid and diethylenetriamine-N,N,N',N'-tetramethylenephosphonic acid; and hydrolyzed products of maleic anhydride polymers described in EP-A-345172.

Overflowed solutions caused by replenishment of washing water and/or the stabilizing solutions can be reused in other stages such as the desilverization stage.

In the processing by the use of automatic processors, when the respective processing solutions described above are concentrated by vaporization, it is preferred to replenish water, or correcting solutions or processing replenishers in appropriate amounts to correct concentration due to evaporation. There is no particular limitation on specific methods for replenishing water, but the following processes are preferred among others:

(1) The process of determining the amount of evaporated water in a monitor tank provided in addition to a bleaching tank, calculating the amount of evaporated water in the bleaching tank from the amount of evaporated water in the monitor tank, and replenishing water to the bleaching tank in proportion to the determined amount of evaporated water (described in JP-A-1-254959 and JP-A-1-254960); and (2) The process of correcting concentration using a liquid level sensor or an overflow sensor (described in JP-A-3-248155, JP-A-3-249644, JP-A-3-249645 and JP-A-3-249646)

Although service water may be used as water for correcting evaporation of the respective processing solutions, deionized water or sterilized water preferably used in the above-described washing stage is also preferably employed.

In the present invention, the various processing solutions are used at 10° to 50° C. The standard temperatures are usually from 33° to 38° C., but the use of higher temperatures can promote the processing to save the processing time, and conversely, the use of lower temperatures can improve image quality and stability of the processing solutions.

In the present invention, the respective solutions can be used for processing two or more kinds of photographic materials in common. For example, color negative films and color papers can be processed using the same processing solution, thereby reducing the cost of a processor and simplifying the processing.

The present invention will be illustrated in more detail with reference to examples below, but these are not to be construed as limiting the invention.

EXAMPLE 1

Preparation of Emulsion I: Cubic Silver Chlorobromide (Comparison)

In a reaction vessel was placed 1200 ml of an aqueous solution of gelatin (containing 28 g of gelatin, 4.0 g of NaCl and 3.2 ml of N,N'-dimethylimidazoline-2-thione (1% aqueous solution)). Then, 200.0 ml of an aqueous solution of $AgNO_3$ (containing 32.9 g of $AgNO_3$) and 200.0 ml of an aqueous solution of NaCl (containing 14.1 g of NaCl) were added and mixed for 24 minutes at 52° C. with stirring. After addition of $4.2\times10^{-4}$ mol of a thiosulfonic acid compound, 523.0 ml of an aqueous solution of $AgNO_3$ (containing 156.9 g of $AgNO_3$) and 523.0 ml of an aqueous solution of NaCl (containing 54.0 g of NaCl) were added and mixed for 26 minutes and 9 seconds at 52° C. Subsequently, a fine-grain AgBr emulsion given later was added in an Ag amount of $1.3\times10^{-3}$ mol, followed by ripening for 5 minutes. After keeping at 52° C. for 15 minutes, the temperature was lowered to 35° C., and desilverization and washing were conducted according to conventional methods.

The average sphere-corresponding diameter of the resulting emulsion was 1.0 μm.

Preparation of Fine-Grain AgBr Emulsion

In a reaction vessel was placed 1200 ml of an aqueous solution of gelatin (containing 24 g of gelatin having an average molecular weight of 30,000 (hereinafter referred to as M3 gelatin) and 0.09 g of KBr, pH 3.0). Then, 240.0 ml of an aqueous solution of $AgNO_3$ (containing 60.0 g of $AgNO_3$, 2.0 g of M3 gelatin and 1.0 ml of 1M $HNO_3$) and 240.0 ml of an aqueous solution of KBr (containing 42.0 g of KBr, 2.0 g of M3 gelatin and 1.0 ml of 1M KOH) were concurrently added and mixed at 90 cc/minute for 2 minutes and 40 seconds at 23° C. with stirring. After stirring for 30 seconds, the pH and the pBr were adjusted to 4.0 and 3.2, respectively.

The mean sphere-corresponding diameter of the resulting fine-grain AgBr emulsion was 0.04 μm.

Preparation of Emulsion 2: Tabular Silver Iodobromide (Comparison)

Emulsion B-1 given later containing silver bromide in an amount corresponding to 164 g of $AgNO_3$ was added to 1950 cc of water. The temperature was kept at 55° C., the pAg at 8.9, and the pH at 5.0. Then, 126 cc of a 0.32M aqueous solution of KI was quantitatively added for 5 minutes, and subsequently, 206 cc of a 1.9M aqueous solution of $AgNO_3$ and an aqueous solution of KBr were added for 36 minutes so as to keeping the pAg at 8.9. Then, desalting was carried out by conventional flocculation. The resulting silver iodobromide emulsion comprised tabular grains having a mean circle-corresponding diameter of 2.1 μm, a mean thickness of 0.30 μm and a mean aspect ratio of 7, and grains having an aspect ratio of 4 or more occupied 80% or more of the total projected area.

Preparation of Emulsion B-1 (Core Emulsion of Emulsion B)

An aqueous solution (1200 cc) containing 6.2 g of gelatin and 6.4 g of KBr was stirred keeping the temperature at 60° C., and 8 cc of a 1.9M aqueous solution of $AgNO_3$ and 9.6 cc of a 1.7M aqueous solution of KBr were added by the double jet process for 45 seconds. After additional addition of 38 g of gelatin, the temperature was elevated to 75° C., and ripening was conducted in the presence of $NH_3$ for 20 minutes. After neutralization with $HNO_3$, 405 cc of a 1.9M aqueous solution of $AgNO_3$ and an aqueous solution of KBr were added for 87 minutes keeping the pAg at 8.22 and accelerating the flow rate (the flow rate at the end is 10 times that at the start). Then, the emulsion was cooled to 35° C., and desalted by the conventional flocculation process. The resulting silver bromide emulsion comprised tabular grains having a mean circle-corresponding diameter of 2.0 μm, a mean thickness of 0.25 μm and a mean aspect ratio of 8.

Preparation of Emulsion 3: Tabular Silver Chlorobromide (Invention)

In a reaction vessel was placed 1200 ml of an aqueous solution of gelatin (containing 18.0 g of gelatin, pH 4.3). Then, 12.0 ml of an aqueous solution of $AgNO_3$ (containing 2.40 g of $AgNO_3$) and 12.0 ml of an aqueous solution of NaCl (containing 0.83 g of NaCl) were concurrently added and mixed at 24 ml/minute at 45° C. with stirring. After stirring for 1 minute, 19.0 ml of an aqueous solution of $AgNO_3$ (containing 0.38 g of $AgNO_3$) and 19.0 ml of an aqueous solution of KBr (containing 0.27 g of KBr) were concurrently added and mixed at 30 ml/minute. After stirring for 1 minute, 36.0 ml of an aqueous solution of $AgNO_3$ (containing 7.20 g of $AgNO_3$) and 36.0 ml of an aqueous solution of NaCl (containing 2.48 g of NaCl) were concurrently added and mixed at 48 ml/minute. Subsequently, 20.0 ml of an aqueous solution of NaCl (containing 2.0 g of NaCl) was added and the resulting solution was adjusted to pH 4.8.

After ripening at 70° C. for 16 minutes, a fine-grain AgCl emulsion given later was added in an Ag amount of 0.997 mol, followed by ripening for 35 minutes. The fine-grain AgBr emulsion used for preparation of emulsion 1 was further added in an Ag amount of 0.003 mol, followed by ripening for 6 minutes.

Then, the temperature was lowered to 35° C., and the emulsion was washed by the conventional precipitation washing process. An aqueous solution of gelatin was added thereto, and the temperature was adjusted to 40° C. The pH of the emulsion was adjusted to 6.4, and the pCl to 2.8.

The resulting silver chlorobromide grains had a mean sphere-corresponding diameter of 1.0 μm and an aspect ratio of 7, and tabular grains occupied 90% of the total projected area.

Preparation of Fine-Grain AgCl Emulsion

In a reaction vessel was placed 1200 ml of an aqueous solution of gelatin (containing 24 g of M3 gelatin and 0.5 g of NaCl, pH 3.0). Then, 900.0 ml of an aqueous solution of $AgNO_3$ (containing 225.0 g of $AgNO_3$, 9.0 g of M3 gelatin and 2.3 ml of 1M $HNO_3$) and 900.0 ml of an aqueous solution of NaCl (containing 77.4 g of NaCl, 9.0 g of M3 gelatin and 2.3 ml of 1M KOH) were concurrently added and mixed at 90 cc/minute for 10 minutes at 23° C. with stirring. After stirring for 30 seconds, the pH and the pCl were adjusted to 4.0 and 1.7, respectively.

The mean sphere-corresponding diameter of the resulting fine-grain AgCl emulsion was 0.06 μm.

Emulsions 1 to 3 were subjected to the following chemical sensitization under the conditions of 60° C., pH 6.20 and pAg 8.40 and spectral sensitized emulsions 1-A to 1-F, 2-A to 2-F and 3-A to 3-F shown in Table 2 were prepared.

TABLE 2

| Spectral Sensitized Einulsion | Emulsion Used | Dye Used | Remarks |
|---|---|---|---|
| 1-A | 1 | A | Comparison |
| 1-B | 1 | B | Comparison |
| 1-C | 1 | C | Comparison |
| 1-D | 1 | D | Comparison |
| 1-E | 1 | E | Comparison |
| 1-F | 1 | F | Comparison |
| 2-A | 2 | A | Comparison |
| 2-B | 2 | B | Comparison |
| 2-C | 2 | C | Comparison |
| 2-D | 2 | D | Comparison |
| 2-E | 2 | E | Comparison |
| 2-F | 2 | F | Comparison |
| 3-A | 3 | A | Invention |
| 3-B | 3 | B | Invention |
| 3-C | 3 | C | Invention |
| 3-D | 3 | D | Comparison |
| 3-E | 3 | E | Comparison |
| 3-F | 3 | F | Comparison |

First, sensitizing dyes A to F were each added to emulsions 1 to 3 in an amount corresponding to 80% of the saturated adsorption. Sensitizing dyes according to the present invention to be used are shown below:

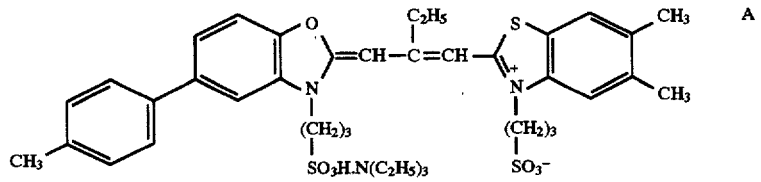

-continued

B

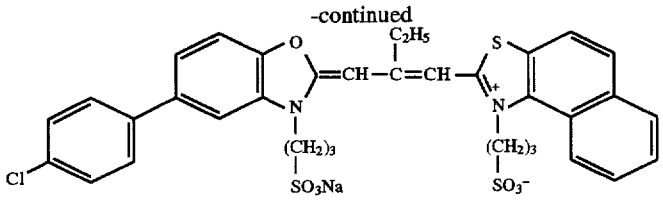

C

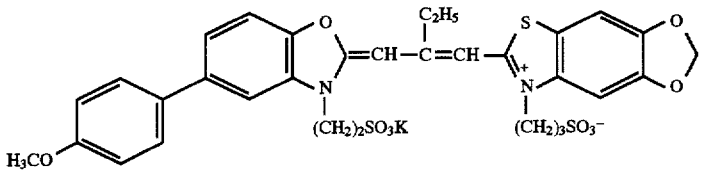

D

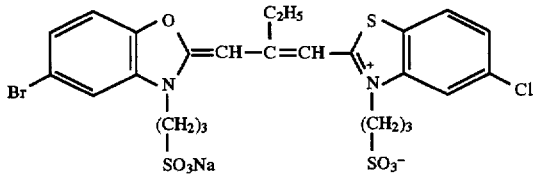

E

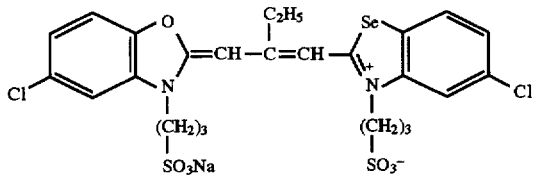

F

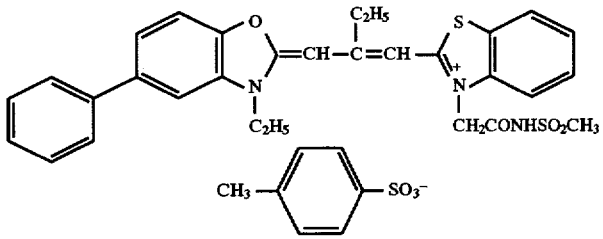

Subsequently, $3.0\times10^{-3}$ mol/mol of silver of potassium thiocyanate, $6\times10^{-6}$ mol/mol of silver of potassium chloroaurate, $1\times10^{-5}$ mol/mol of silver of sodium thiosulfate and $3\times10^{-6}$ mol/mol of silver halide of the selenium sensitizer shown below were added, followed by ripening at 60° C. The ripening time was controlled so that the sensitivity on exposure for 1/100 second reaches a maximum.

Selenium Sensitizer

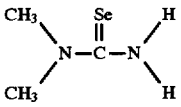

After termination of chemical sensitization, the compounds shown below were added to spectral sensitized emulsions 1-A to 3-F described above, and triacetyl cellulose film supports having a subbing layer were coated therewith together with protective layers by the simultaneous extrusion method so as to give a silver amount of 0.5 g/m$^2$, thereby preparing samples 1 to 18.

(1) Emulsion Layer

Emulsion: each spectral sensitized emulsion described above

Compound 1 represented by structural formula shown below

Tricresyl Phosphate

Stabilizer: 4-Hydroxy-6-methyl-1,3,3a,7-tetraazaindene

Coating Aid: Sodium Dodecylbenzenesulfonate

Compound 1

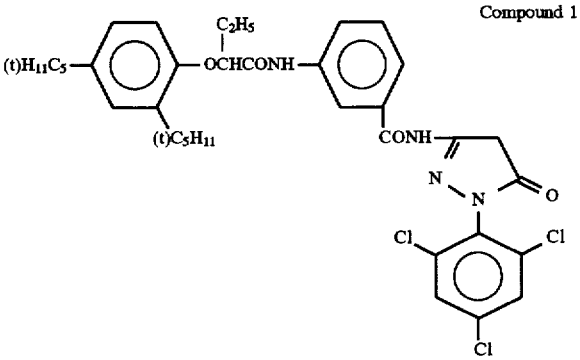

(2) Protective Layer

Fine Polymethyl Methacrylate Grains Sodium Salt of 2,4-Dichloro-6-hydroxy-s-triazine Gelatin These samples were subjected to exposure for sensitometry for 1/100 second, and then to the following rapid color processing.

(Processing Stage)

| Stage | Processing Time | Processing Temperature |
|---|---|---|
| Color Development | 45 seconds | 38° C. |
| Bleaching | 30 seconds | 38° C. |
| Fixing | 45 seconds | 38° C. |
| Stabilization (1) | 20 seconds | 38° C. |
| Stabilization (2) | 20 seconds | 38° C. |
| Stabilization (3) | 20 seconds | 38° C. |
| Drying | 30 seconds | 60° C. |

Stabilization was conducted by a countercurrent system from (3) to (1).

Compositions of processing solutions are described below:

| | |
|---|---|
| (Color Developing Solution) | |
| Ethylenediaminetetraacetic Acid | 3.0 g |
| Disodium 4,5-Dihydroxybenzene-1,3-disulfonate | 0.3 g |
| Potassium Carbonate | 30.0 g |
| Sodium Chloride | 5.0 g |
| Disodium N,N-bis(sulfonatoethyl)hydroxylamine | 6 0 g |
| 4-[N-Ethyl-N-(β-hydroxyethyl)amino]-2-methylaniline Sulfate | 5.0 g |
| Water to make | 1.0 liter |
| pH (adjusted with potassium hydroxide and sulfuric acid) | 10.00 |
| (Bleaching Solution) | |
| Ammonium 1,3-Diaminopropane-tetraacetato Ferrate Monohydrate | 140 g |
| 1,3-Diaminopropanetetraacetic Acid | 3 g |
| Ammonium Bromide | 80 g |
| Ammonium Nitrate | 15 g |
| Hydroxyacetic Acid | 25 g |
| Acetic Acid (98%) | 40 g |
| Water to make | 1.0 liter |
| pH (adjusted with aqueous ammonia and acetic acid) | 4.3 |
| (Fixing Solution) | |
| Disodium Ethylenediaminetetraacetate | 15 g |
| Ammonium Sulfite | 19 g |
| Imidazole | 15 g |
| Ammonium Thiosulfate (70 wt %) | 280 ml |
| Water to make | 1.0 liter |
| pH (adjusted with aqueous ammonia and acetic acid) | 7.4 |
| (Stabilizing Solution) | |
| Sodium p-Toluenesulfinate | 0.03 g |
| Polyoxyethylene-p-monononyl Phenyl Ether (average degree of polymerization: 10) | 0.2 g |
| Disodium Ethylenediaminetetraacetate | 0.05 g |
| 1,2,4-Triazole | 1.3 g |
| 1,4-Bis(1,2,4-triazole-1-ylmethyl)piperazine | 0.75 g |
| Water to make | 1.0 liter |
| pH (adjusted with aqueous ammonia and acetic acid) | 8.5 |

For the processed samples, the density was measured through a green filter.

The sensitivity was defined as the reciprocal of an exposure amount required to give a density of fog +0.1, and represented by a relative value to the value of sample 1 which was taken as 100. The values of sensitivity are shown in Table 3 given below.

TABLE 3

| Sample No. | Spectral Sensitized Emulsion Used | Sensitivity | Remarks |
|---|---|---|---|
| 1 | 1-A | 100 | Comparison |
| 2 | 1-B | 100 | Comparison |
| 3 | 1-C | 95 | Comparison |
| 4 | 1-D | 90 | Comparison |
| 5 | 1-E | 75 | Comparison |
| 6 | 1-F | 80 | Comparison |
| 7 | 2-A | 150 | Comparison |
| 8 | 2-B | 150 | Comparison |
| 9 | 2-C | 145 | Comparison |
| 10 | 2-D | 140 | Comparison |
| 11 | 2-E | 135 | Comparison |
| 12 | 2-F | 130 | Comparison |
| 13 | 3-A | 320 | Invention |
| 14 | 3-B | 315 | Invention |
| 15 | 3-C | 300 | Invention |
| 16 | 3-D | 295 | Invention |
| 17 | 3-E | 190 | Comparison |
| 18 | 3-F | 180 | Comparison |

The results shown in Table 3 reveals that the emulsions of the present invention are high in sensitivity.

EXAMPLE 2

A cellulose triacetate film support having a subbing was coated with the following respective compositions in multiple layers to prepare a sample, a multilayer color photographic material.

(Compositions of Light-Sensitive Layers)

Materials used in the respective layers are classified as follows:

ExC: Cyan Coupler UV: Ultraviolet Light Absorber
ExM: Magenta Coupler HBS: High Boiling Organic Solvent
ExY: Yellow Coupler H: Hardening Agent for Gelatin
ExS: Sensitizing Dye Numerals corresponding to respective components indicate amounts coated in g/m$^2$. For silver halides, numerals indicate amounts coated which are converted to silver. However, for sensitizing dyes, numerals indicate amounts coated in mole per mole of silver halide in the same layers.

| | |
|---|---|
| First Layer (Antihalation Layer) | |
| Black Colloidal Silver | silver 0.09 |
| Gelatin | 1.30 |
| ExM-1 | 0.12 |
| ExF-1 | $2.0 \times 10^{-3}$ |
| Solid Disperse Dye ExF-2 | 0.030 |
| Solid Disperse Dye ExF-3 | 0.040 |
| HBS-1 | 0.15 |
| HBS-2 | 0.02 |
| Second Layer (Intermediate Layer) | |
| ExC-2 | 0.04 |
| Polyethyl Acrylate Latex | 0.20 |
| Gelatin | 1.04 |
| Third Layer (Low-Sensitivity Red-Sensitive Emulsion Layer) | |
| Silver Chlorobromide Emulsion A | silver 0.25 |
| Silver Chlorobromide Emulsion B | silver 0.25 |
| ExS-1 | $6.9 \times 10^{5}$ |
| ExS-2 | $1.8 \times 10^{5}$ |
| ExS-3 | $3.1 \times 10^{4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |

-continued

| | | |
|---|---|---|
| HBS-1 | | 0.10 |
| Gelatin | | 0.87 |

Fourth Layer (Middle-Sensitivity Red-Sensitive Emulsion Layer)

| | | |
|---|---|---|
| Silver Chlorobromide Emulsion C | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |

Fifth Layer (High-Sensitivity Red-Sensitive Emulsion Layer)

| | | |
|---|---|---|
| Silver Chlorobromide Einulsion D | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |

Sixth Layer (Intermediate Layer)

| | | |
|---|---|---|
| Cpd-1 | | 0.090 |
| Solid Disperse Dye ExF-4 | | 0.030 |
| HBS-1 | | 0.050 |
| Polyethyl Acrylate Latex | | 0.15 |
| Geiatin | | 1.10 |

Seventh Layer (Low-Sensitivity Green-Sensitive Emulsion Layer)

| | | |
|---|---|---|
| Silver Chlorobromide Emulsion E | silver | 0.15 |
| Silver Chlorobromide Emulsion F | silver | 0.10 |
| Silver Chlorobromide Emulsion G | silver | 0.10 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |

Eighth Layer (Middle-Sensitivity Green-Sensitive Emulsion Layer)

| | | |
|---|---|---|
| Silver Chlorobromide Emulsion H | silver | 0.80 |
| Exs-4 | | $3.2 \times 10^{-5}$ |
| Exs-5 | | $2.2 \times 10^{-4}$ |
| Exs-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.88 |

Ninth Layer (High-Sensitivity Green-Sensitive Emulsion Layer)

| | | |
|---|---|---|
| Silver Chlorobromide Emulsion X | silver | 1.25 |

-continued

| | | |
|---|---|---|
| (prepared in Example 1) | | |
| ExS-5 | | $3.7 \times 10^{-5}$ |
| ExS-6 | | $8.1 \times 10^{-5}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethyl Acrylate Latex | | 0.15 |
| Gelatin | | 1.00 |

Tenth Layer (Yellow Filter Layer)

| | | |
|---|---|---|
| Yellow Colloidal Silver | silver | 0.015 |
| Cpd-1 | | 0.16 |
| Solid Disperse Dye ExF-5 | | 0.060 |
| Solid Disperse Dye ExF-6 | | 0.060 |
| Oil-Soluble Dye ExF-7 | | 0.010 |
| HBS-1 | | 0.60 |
| Gelatin | | 0.70 |

Eleventh Layer (Low-Sensitivity Blue-Sensitive Emulsion Layer)

| | | |
|---|---|---|
| Silver Chlorobromide Emulsion I | silver | 0.09 |
| Silver Chlorobromide Emulsion J | silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.73 |
| ExY-4 | | 0.020 |
| Cpd-2 | | 0.10 |
| Cpd-3 | | $4.0 \times 10^{-3}$ |
| HBS-1 | | 0.32 |
| Gelatin | | 1.20 |

Twelfth Layer (High-Sensitivity Blue-Sensitive Emulsion Layer)

| | | |
|---|---|---|
| Silver Chlorobromide Emulsion K | silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |

Thirteenth Layer (First Protective Layer)

| | | |
|---|---|---|
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.2 |

Fourteenth Layer (Second Protective Layer)

| | | |
|---|---|---|
| Silver Chlorobromide Emulsion L | silver | 0.10 |
| H-1 | | 0.40 |
| B-1 (diameter: about 1.7 μm) | | $5.0 \times 10^{-2}$ |
| B-2 (diameter: about 1.7 μm) | | 0.15 |
| B-3 | | 0.05 |
| S-1 | | 0.20 |
| Gelatin | | 0.70 |

In addition, each layer appropriately contains any of W-1 to W-3, B-4 to B-6, F-1 to F-17, an iron salt, a lead salt, a gold salt, a platinum salt, a palladium salt, an iridium salt and a rhodium salt in order to improve keeping quality, processability, pressure resistance, mold proofing, bacteria proofing, antistatic quality and coating quality.

TABLE 4

| | Shape of Grain | Content of Silver Chloride (mol %) | Silver Bromide Localized on Surface (mol %) | Mean Grain Size, Sphere-Corresponding Dia. (μm) | Mean Aspect Ratio | Circle-Corresponding Dia. of Projected Area (μm) | Grain Size Distribution, Coefficient of Variation (%) |
|---|---|---|---|---|---|---|---|
| Emulsion A | Right-angled parallelogram, tabular | 99.2 | 0.8 | 0.46 | 5.5 | 0.56 | 15 |
| Emulsion B | Right-angled parallelogram, tabular | 99.2 | 0.8 | 0.57 | 4.0 | 0.78 | 20 |
| Emulsion C | Right-angled parallelogram, tabular | 99.3 | 0.7 | 0.66 | 5.8 | 0.87 | 25 |
| Emulsion D | Right-angled parallelogram, tabular | 99.5 | 0.5 | 0.84 | 3.7 | 1.03 | 26 |
| Emulsion E | Right-angled parallelogram, tabular | 99.2 | 0.8 | 0.46 | 5.5 | 0.56 | 15 |
| Emulsion F | Right-angled parallelogram, tabular | 99.3 | 0.7 | 0.57 | 4.0 | 0.78 | 20 |
| Emulsion G | Right-angled parallelogram, tabular | 99.2 | 0.8 | 0.61 | 4.4 | 0.77 | 23 |
| Emulsion H | Right-angled parallelogram, tabular | 99.2 | 0.8 | 0.61 | 4.4 | 0.77 | 23 |
| Emulsion I | Right-angled parallelogram, tabular | 99.2 | 0.2 | 0.46 | 4.2 | 0.5 | 15 |
| Emulsion J | Right-angled parallelogram, tabular | 99.3 | 0.7 | 0.64 | 5.2 | 0.85 | 23 |
| Emulsion K | Right-angled parallelogram, tabular | 99.6 | 0.4 | 1.28 | 3.5 | 1.46 | 26 |
| Emulsion L | Cube | 100.0 | 0.0 | 0.07 | 1.0 | | 15 |

In Table 4, (1) Emulsions I to K are subjected to reduction sensitization using thiourea dioxide and thiosulfonic acid in preparing the grains according to the examples of JP-A-2-191938 (corresponding to U.S. Pat. No. 5,061,614);

(2) Emulsions A to H are subjected to gold sensitization, sulfur sensitization and selenium sensitization in the presence of the spectral sensitizing dyes contained in the respective light-sensitive layers and sodium thiocyanate according to the examples of JP-A-3-237450 (corresponding to EP-A-443453); and (3) The tabular grains are prepared according to the examples of U.S. Pat. No. 5,264,337.

Preparation of Dispersion of Organic Solid Disperse Dye

ExF-2 shown below was dispersed in the following manner. Namely, 21.7 ml of water, 3 ml of a 5% aqueous solution of sodium p-octylphenoxyethoxyethanesulfonate and 0.5 g of a 5% aqueous solution of p-octylphenoxy polyoxyethylene ether (polymerization degree: 10) were placed in a 700-ml pot mill, and 5.0 g of dye ExF-2 and 500 ml of zirconium beads (diameter: 1 mm) were added thereto to disperse the contents for 2 hours. For this dispersion, a BO type vibrating ball mill manufactured by Chuoh Kohki Co. was used. After dispersion, the contents were taken out and added to 8 g of a 12.5% aqueous solution of gelatin, followed by removal of the beads to obtain a dispersion of the dye in gelatin. The mean grain size of the fine dye grains was 0.44 μm.

Similarly, solid dispersions of ExF-3, ExF-4 and ExF-6 were obtained. The mean grain size of the fine dye grains was 0.24 μm, 0.45 μm and 0.52 μm, for ExF-3, ExF-4 and ExF-6, respectively. ExF-5 was dispersed by the microprecipitation dispersion method ascribed in Example 1 of EP-A-549489. The mean grain size was 0.06 μm.

ExC-1

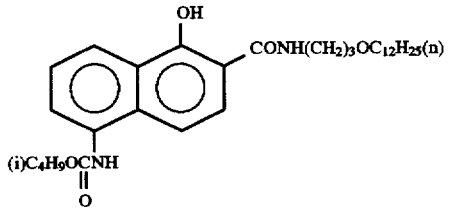

-continued
ExC-2
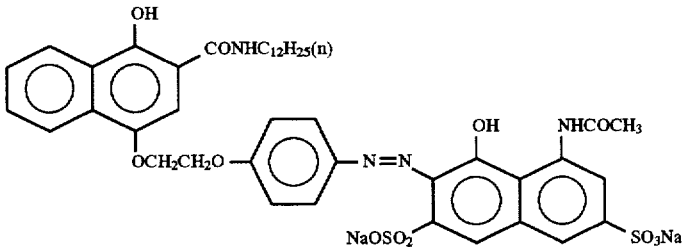
ExC-3
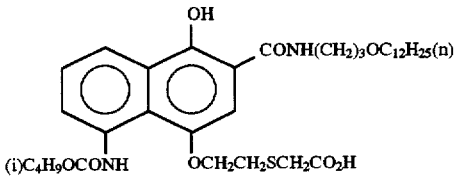
ExC-4
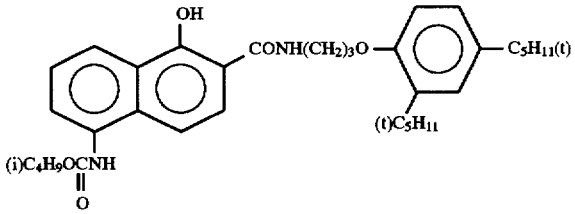
ExC-5
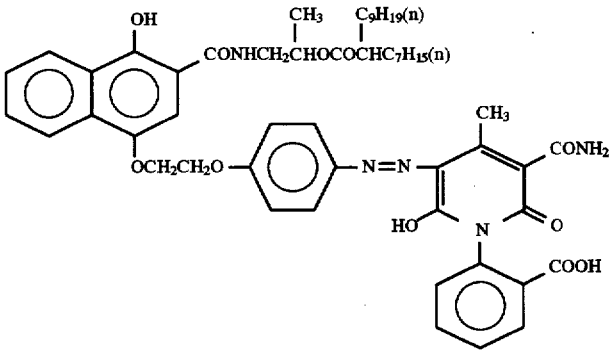
ExC-6
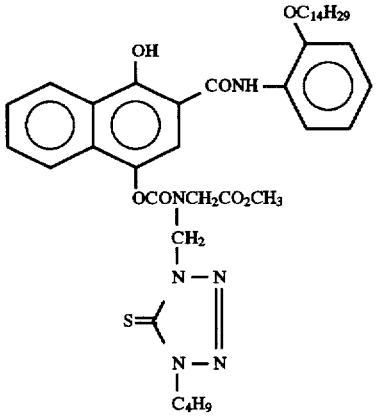
ExC-7
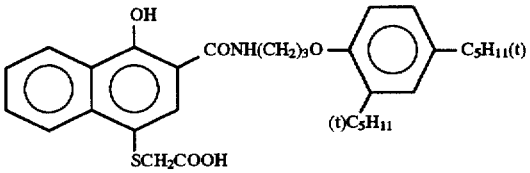

-continued
ExC-8
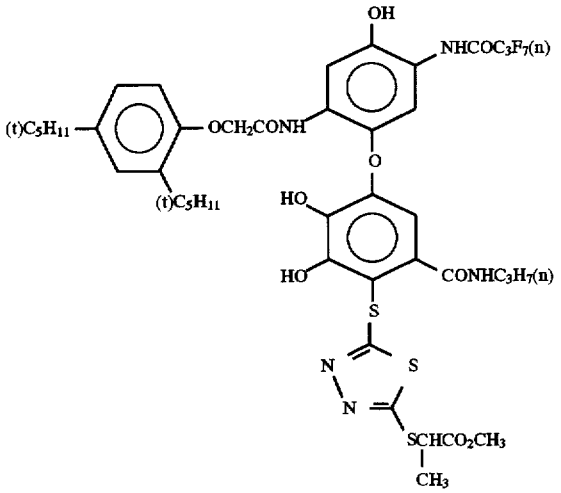
ExM-1
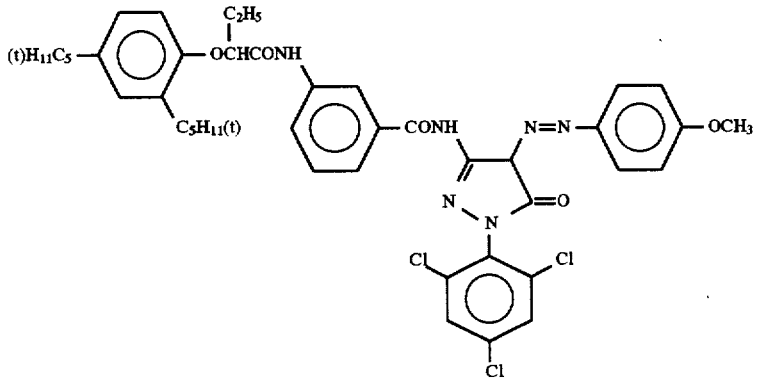
ExM-2
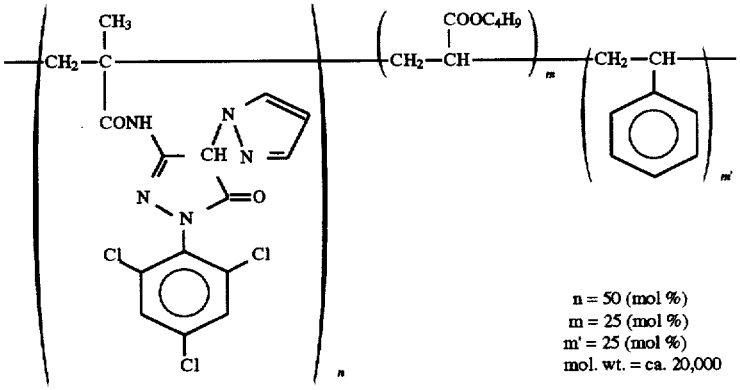
n = 50 (mol %)
m = 25 (mol %)
m' = 25 (mol %)
mol. wt. = ca. 20,000
ExM-3
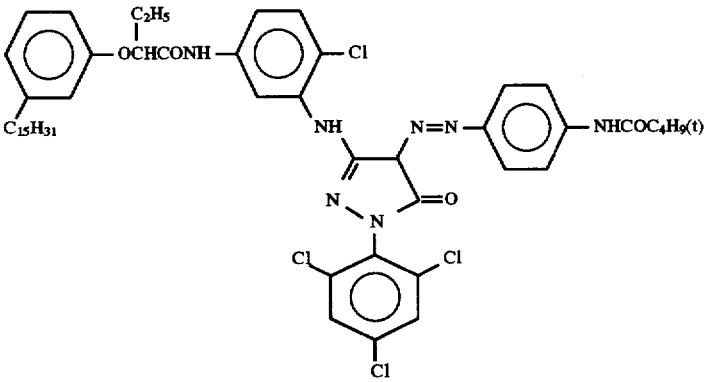

-continued
ExM-4
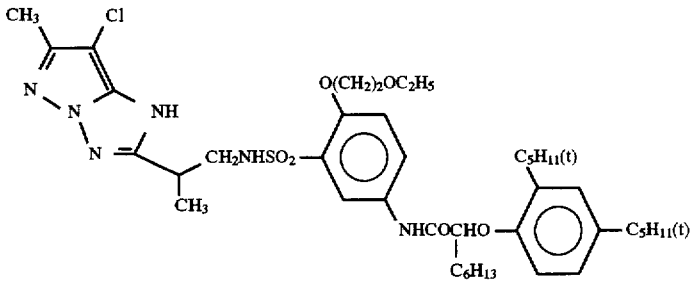
ExM-5
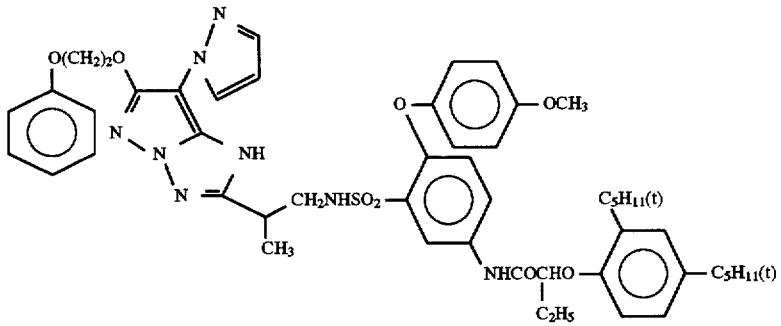
ExY-1
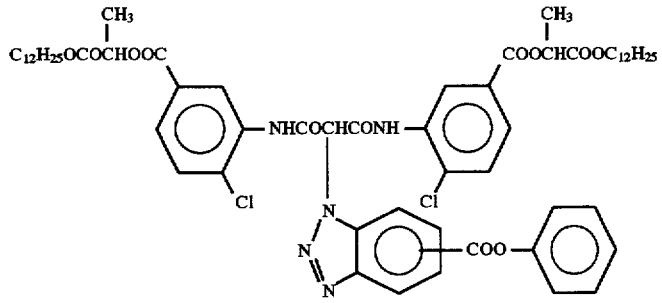
ExY-2
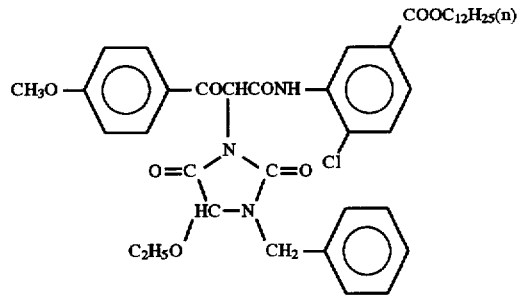
ExY-3
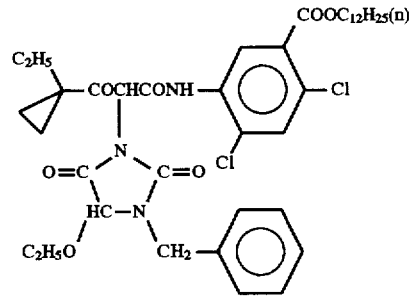

-continued
ExY-4
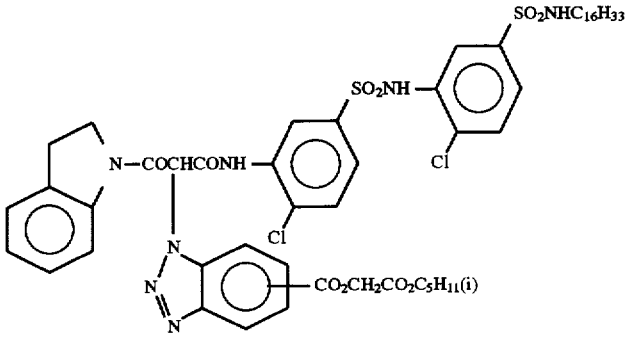
ExY-5
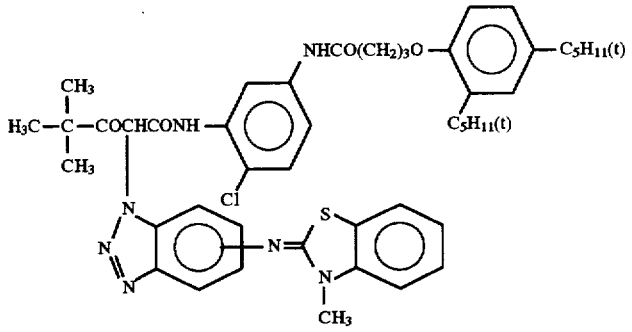
ExF-1
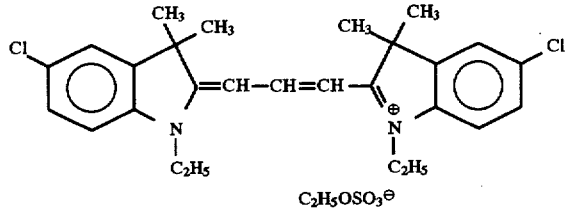
ExF-2
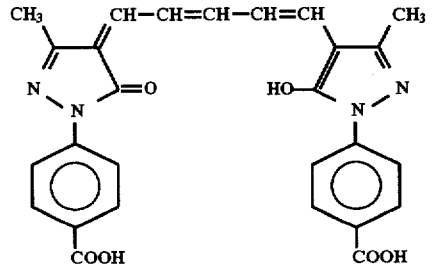
ExF-3
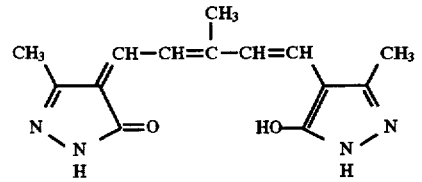
ExF-4
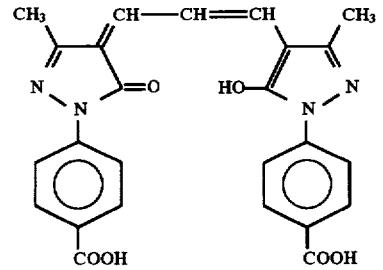

-continued
ExF-5
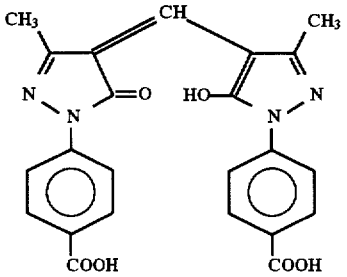
ExF-6
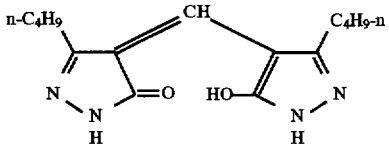
ExF-7
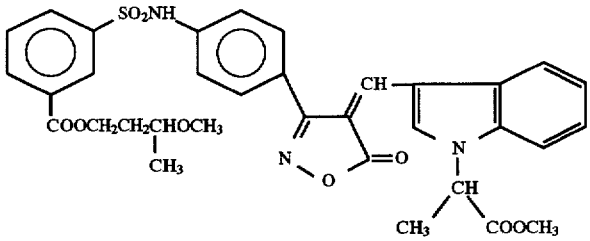
Cpd-1
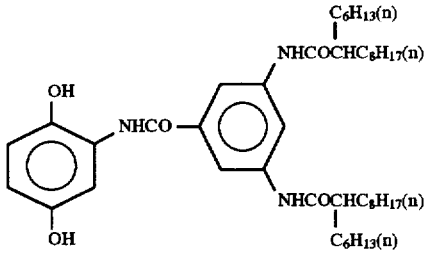
Cpd-2
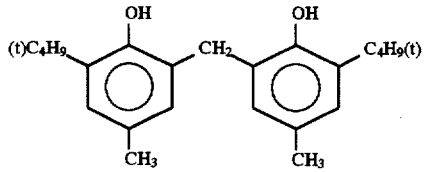
Cpd-3
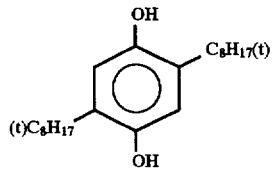
UV-1
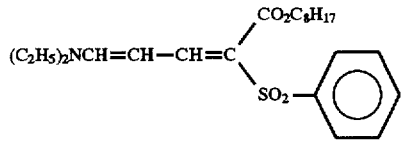
UV-2
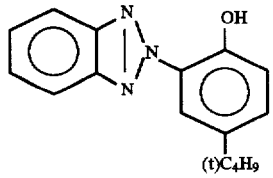

-continued
UV-3
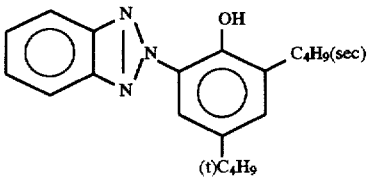
Tricresyl phosphate — HBS-1
Di-n-butyl phthalate — HBS-2
HBS-3
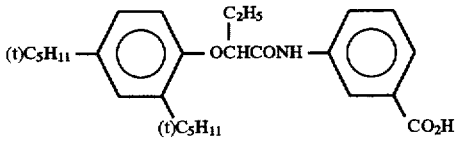
Tri(2-ethylhexyl) phosphate — HBS-4
ExS-1
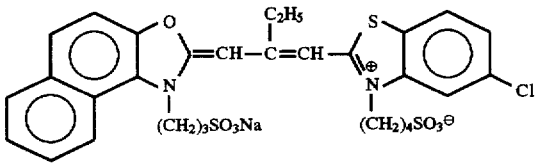
ExS-2
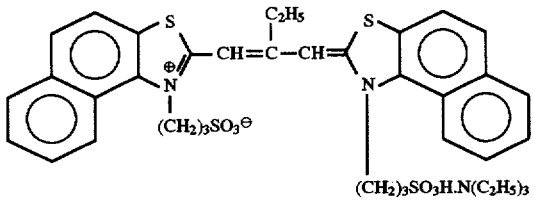
ExS-3
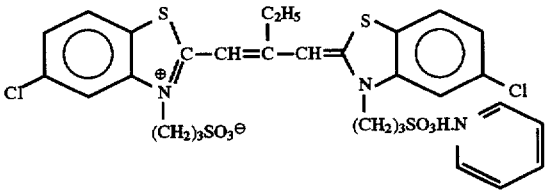
ExS-4
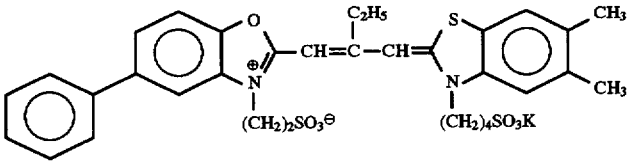
ExS-5
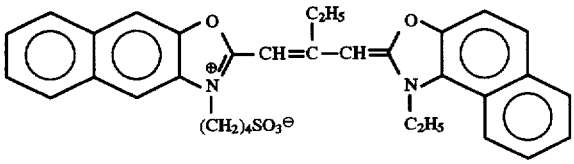
ExS-6
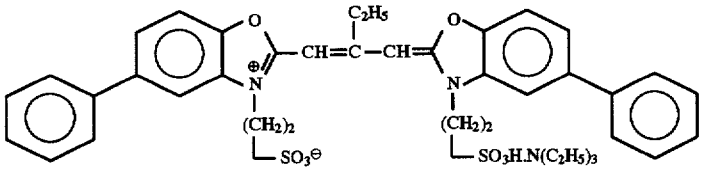

-continued
ExS-7
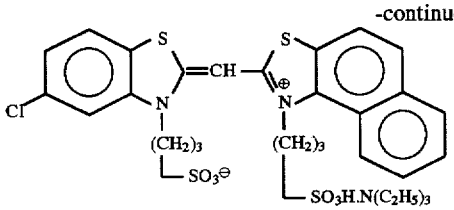
S-1
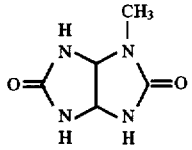
H-1
$CH_2{=}CH{-}SO_2{-}CH_2{-}CONH{-}CH_2$
$CH_2{=}CH{-}SO_2{-}CH_2{-}CONH{-}CH_2$
B-1
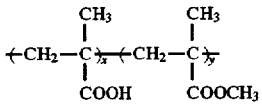
x/y = 10/90 (mol %)
B-2
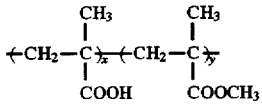
x/y = 40/60 (mol %)
B-3
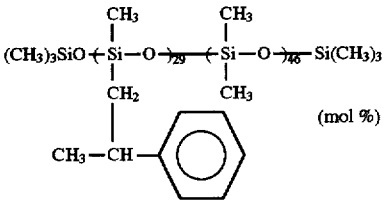
(mol %)
B-4
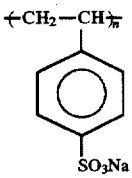
(n = an integer of ca. 1,000)
B-5
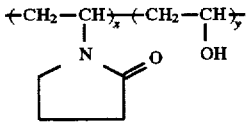
x/y = 70/30 (mol %)
B-6
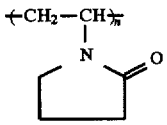
(mol. wt. = ca. 10,000)
(n = an integer)
W-1
$C_8F_{17}SO_2NHCH_2CH_2CH_2OCH_2CH_2\overset{\oplus}{N}(CH_3)_3$
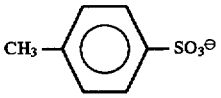
W-2
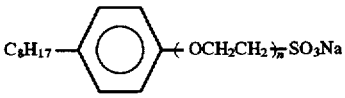
n = 2–4

-continued
W-3
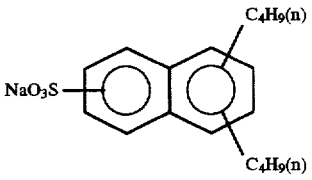
F-1
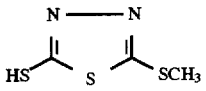
F-2
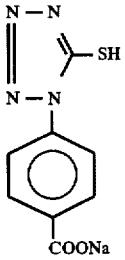
F-3
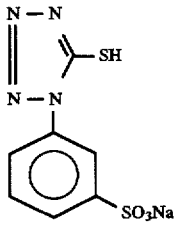
F-4
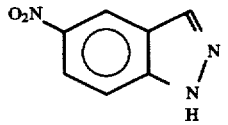
F-5
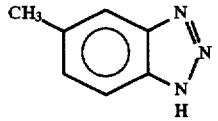
F-6
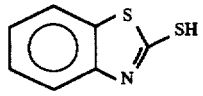
F-7
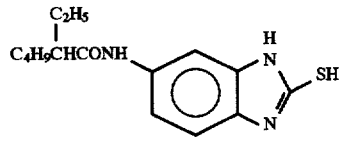
F-8
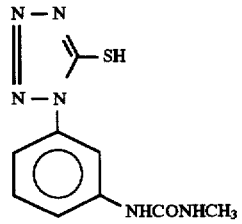
F-9
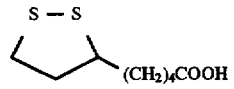

-continued

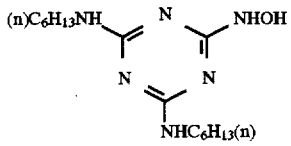

F-10

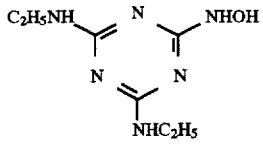

F-11

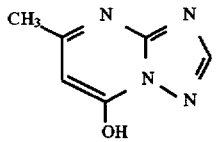

F-12

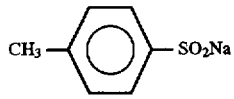

F-13

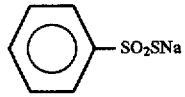

F-14

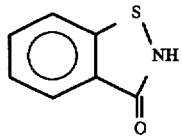

F-15

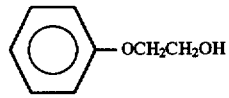

F-16

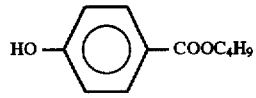

F-17

Spectral sensitized emulsions 1-A to 3-F described in Example 1 were each used as emulsion X of the ninth layer (high-sensitivity green-sensitive layer), thereby preparing samples 19 to 36.

These samples 19 to 36 were subjected to exposure for sensitometry for 1/100 second, and then to the rapid color processing shown in Example 1.

For a characteristic curve of a magenta color image, the toe sensitivity was represented by a relative value taking the value of sample 15 as 100, and results are shown in Table 5 given below.

Further, using these samples, the keeping quality was evaluated at a temperature of 50° C. at a humidity of 80% RH for 2 days.

The keeping quality was evaluated for a characteristic curve of a yellow color image by using the sensitivity defined as the reciprocal of an exposure amount required to give a density 1.0 higher than the fog density. The sensitivity at the time when the sample was stored was evaluated by a relative value taking the sensitivity of sample 19 at this time as 10. Results are shown in Table 5 given below.

TABLE 5

| Sample No. | Color Sensitizing Dye Used in Emulsion of the Ninth Layer | Toe Sensitivity | Keeping Quality | Remarks |
|---|---|---|---|---|
| 19 | 1-A | 100 | 10 | Comparison |
| 20 | 1-B | 95 | 10 | Comparison |
| 21 | 1-C | 90 | 11 | Comparison |
| 22 | 1-D | 90 | 13 | Comparison |
| 23 | 1-E | 80 | 15 | Comparison |
| 24 | 1-F | 80 | 25 | Comparison |
| 25 | 2-A | 145 | 10 | Comparison |
| 26 | 2-B | 150 | 10 | Comparison |
| 27 | 2-C | 140 | 10 | Comparison |
| 28 | 2-D | 135 | 10 | Comparison |
| 29 | 2-E | 130 | 10 | Comparison |
| 30 | 2-F | 130 | 10 | Comparison |
| 31 | 3-A | 320 | 10 | Invention |
| 32 | 3-B | 320 | 11 | Invention |
| 33 | 3-C | 300 | 13 | Invention |
| 34 | 3-D | 290 | 35 | Invention |
| 35 | 3-E | 185 | 105 | Comparison |
| 36 | 3-F | 180 | 115 | Comparison |

The results shown in Table 5 reveals that the use of the emulsions of the present invention provides rapidly the effect of high sensitivity and further improves the keeping quality.

As described above (Examples 1 and 2), the silver halide photographic materials of the present invention are excellent in photographic sensitivity.

What is claimed is:

1. A silver halide emulsion in which tabular silver halide grains having {100} faces as two main planes parallel to each other, an aspect ratio of 2 or more and a mean silver chloride content of 50 mol % or more occupy 50% or more of the total projected area of the silver halide grains, said silver halide emulsion being spectrally sensitized with a dye represented by the following formula (I):

(I)

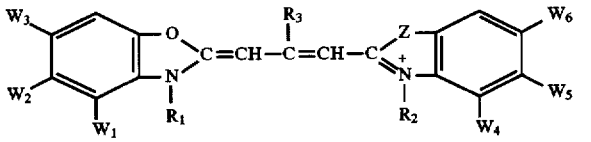

$(X_1)n_1$ wherein Z represents a sulfur atom or a selenium atom; $W_1$, $W_3$ and $W_4$ each represents a hydrogen atom or a bond; $W_2$ represents a phenyl group which is substituted with an alkyl group having 5 or less carbon atoms which may be branched, an alkoxyl group having 4 or less carbon atoms, a chlorine atom, a bromine atom, or an acylamino group having 4 or less carbon atoms; $W_5$ represents an alkyl group having 6 or less carbon atoms, an alkoxyl group having 5 or less carbon atoms, a chlorine atom, a bromine atom, an acylamino group having 6 or less carbon atoms, a monocyclic aryl group, an alkoxycarbonyl group having 6 or less carbon atoms or a carboxyl group, or $W_5$ represents a group of atoms which combines with $W_4$ or $W_6$ to form a tetramethylene group, a trimethylene group, a dioxymethylene group or a benzene group when said $W_4$ or $W_6$ is a bond; $W_6$ represents a bond, a hydrogen atom, a methyl group, an ethyl group, a methoxy group or an ethoxy group; $R_1$ and $R_2$, which may be the same or different, each represents alkyl or alkenyl group having 10 or less carbon atoms, and at least one of $R_1$ and $R_2$ has a sulfo group or a salt thereof; $R_3$ represents a lower alkyl group having 4 or less carbon atoms or a phenyl-substituted alkyl group; $X_1$ represents a pair ion necessary for neutralization of electric charge; and $n_1$ represents 0 or 1, provided that $n_1$ represents 0 when an internal salt is formed.

2. A silver halide photographic material comprising a support having provided thereon at least one silver halide emulsion layer comprising a silver halide emulsion in which tabular silver halide grains having {100} faces as two main planes parallel to each other, an aspect ratio of 2 or more and a mean silver chloride content of 50 mol % or more occupy 50% or more of the total projected area of the silver halide grains, said silver halide emulsion being spectrally sensitized with a dye represented by the following formula (I):

(I)

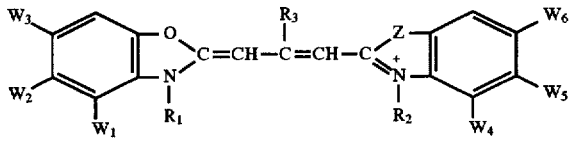

$(X_1)n_1$ wherein Z represents a sulfur atom or a selenium atom; $W_1$, $W_3$ and $W_4$ each represents a hydrogen atom or a bond; $W_2$ represents a phenyl group which is substituted with an alkyl group having 5 or less carbon atoms which may be branched, an alkoxyl group having 4 or less carbon atoms, a chlorine atom, a bromine atom, or an acylamino group having 4 or less carbon atoms; $W_5$ represents an alkyl group having 6 or less carbon atoms, an alkoxyl group having 5 or less carbon atoms, a chlorine atom, a bromine atom, an acylamino group having 6 or less carbon atoms, a monocyclic aryl group, an alkoxycarbonyl group having 6 or less carbon atoms or a carboxyl group, or $W_5$ represents a group of atoms which combines with $W_4$ or $W_6$ to form a tetramethylene group, a trimethylene group, a dioxymethylene group or a benzene group when said $W_4$ or $W_6$ is a bond; $W_6$ represents a bond, a hydrogen atom, a methyl group, an ethyl group, a methoxy group or an ethoxy group; $R_1$ and $R_2$, which may be the same or different, each represents an alkyl or alkenyl group having 10 or less carbon atoms, and at least one of $R_1$ and $R_2$ has a sulfo group or a salt thereof; $R_3$ represents a lower alkyl group having 4 or less carbon atoms or a phenyl-substituted alkyl group; $X_1$ represents a pair ion necessary for neutralization of electric charge; and $n_1$ represents 0 or 1, provided that $n_1$ represents 0 when an internal salt is formed.

3. The silver halide photographic material as claimed in claim 2, wherein the tabular silver halide grains are subjected to gold and sulfur sensitization.

4. The silver halide photographic material as claimed in claim 2, wherein the tabular silver halide grains are subjected to gold and sulfur sensitization in the presence of the dye represented by formula (I).

* * * * *